US009106016B1

(12) United States Patent
Lam et al.

(10) Patent No.: US 9,106,016 B1
(45) Date of Patent: Aug. 11, 2015

(54) ELECTRICAL CONNECTOR

(71) Applicant: GOOGLE INC., Mountain View, CA (US)

(72) Inventors: Lawrence Lam, San Jose, CA (US); Adam Rodriguez, San Francisco, CA (US); Jeffrey Hayashida, San Francisco, CA (US); Kenneth Ryan Loo, San Jose, CA (US); Aaron Leiba, San Francisco, CA (US); Daniel Fourie, San Mateo, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/444,359

(22) Filed: Jul. 28, 2014

Related U.S. Application Data

(63) Continuation of application No. 14/050,047, filed on Oct. 9, 2013, now Pat. No. 8,821,181.

(51) Int. Cl.
*H01R 13/627* (2006.01)

(52) U.S. Cl.
CPC ..... *H01R 13/6275* (2013.01)

(58) Field of Classification Search
CPC ..... H01R 13/6275; H01R 13/6272; H01R 13/65802; H01R 23/7073; H01R 23/02
USPC ..... 439/357, 660, 607.19, 358
See application file for complete search history.

(56) References Cited

U.S. PATENT DOCUMENTS

| | | | |
|---|---|---|---|
| 4,077,690 | A | 3/1978 | Koether |
| 4,579,404 | A | 4/1986 | Lockard |
| 4,993,975 | A | 2/1991 | Asick et al. |
| 5,278,725 | A | 1/1994 | Konno et al. |
| 5,470,238 | A | 11/1995 | Walden |
| 5,574,252 | A | 11/1996 | Hill |
| 5,751,544 | A | 5/1998 | Song |
| 5,766,041 | A | 6/1998 | Morin et al. |
| 5,771,540 | A | 6/1998 | Carpenter et al. |
| 5,941,729 | A | 8/1999 | Sri-Jayantha |
| 5,975,957 | A | 11/1999 | Noda et al. |
| 5,995,373 | A | 11/1999 | Nagai |
| 6,132,253 | A | 10/2000 | Wu |
| 6,132,254 | A | 10/2000 | Wu |

(Continued)

FOREIGN PATENT DOCUMENTS

| | | |
|---|---|---|
| EP | 1670101 A1 | 6/2006 |
| EP | 1933259 A1 | 6/2008 |

(Continued)

OTHER PUBLICATIONS

Non-Final Office Action received for U.S. Appl. No. 14/050,047, mailed on Feb. 6, 2014, 8 pages.

(Continued)

*Primary Examiner* — Gary Paumen

(74) *Attorney, Agent, or Firm* — Brake Hughes Bellermann LLP

(57) ABSTRACT

According to an example embodiment, an electrical connector may include an electrical cord comprising a plurality of wires, and a plug connected to the electrical cord. The plug may include electrical contacts coupled to the plurality of electrical wires, and at least one latch. The at least one latch may be biased to extend away from the plug, an end surface of the at least one latch being within two tenths of a millimeter of an end surface of the plug opposite from the electrical cord.

31 Claims, 20 Drawing Sheets

(56) References Cited

U.S. PATENT DOCUMENTS

| | | | | |
|---|---|---|---|---|
| 6,431,887 | B1 | 8/2002 | Yeomans et al. | |
| 6,461,192 | B1 | 10/2002 | Kwoka | |
| 6,481,057 | B2 | 11/2002 | Lin | |
| 6,860,762 | B2 | 3/2005 | Spykerman et al. | |
| 7,055,215 | B1 | 6/2006 | Ligtenberg et al. | |
| 7,142,898 | B2 | 11/2006 | Takagi | |
| 7,162,388 | B2 | 1/2007 | Johannes et al. | |
| 7,175,475 | B2 | 2/2007 | Hanley | |
| 7,247,058 | B2 | 7/2007 | Reeser et al. | |
| 7,500,288 | B2 | 3/2009 | Chung et al. | |
| 7,645,143 | B2 | 1/2010 | Rohrbach et al. | |
| 7,729,720 | B2 | 6/2010 | Suh et al. | |
| 7,914,328 | B2 | 3/2011 | Tanaka et al. | |
| 7,984,532 | B2 | 7/2011 | Huang | |
| 8,007,315 | B2 | 8/2011 | Whiteman, Jr. | |
| 8,091,178 | B2 | 1/2012 | Degner et al. | |
| 8,337,247 | B2 | 12/2012 | Zhu | |
| 8,475,211 | B2 | 7/2013 | Wang et al. | |
| 8,593,800 | B2 | 11/2013 | Asakura et al. | |
| 8,608,512 | B2 | 12/2013 | Gross | |
| 8,891,244 | B2 | 11/2014 | Yang | |
| 8,959,717 | B2 | 2/2015 | Billings et al. | |
| 2004/0253873 | A1 | 12/2004 | Spykerman et al. | |
| 2006/0024997 | A1 | 2/2006 | Teicher | |
| 2007/0049118 | A1 | 3/2007 | Reeser et al. | |
| 2007/0186382 | A1 | 8/2007 | Huang | |
| 2009/0124134 | A1 | 5/2009 | Moriyama et al. | |
| 2010/0087098 | A1 | 4/2010 | Sloey et al. | |
| 2010/0093215 | A1 | 4/2010 | Xiong et al. | |
| 2010/0151743 | A1 | 6/2010 | Zhou et al. | |
| 2010/0330820 | A1 | 12/2010 | Whiteman, Jr. | |
| 2011/0045685 | A1 | 2/2011 | Kobayashi | |
| 2012/0015561 | A1 | 1/2012 | Tsai | |
| 2012/0071028 | A1 | 3/2012 | Lai et al. | |
| 2013/0095701 | A1 | 4/2013 | Golko et al. | |
| 2013/0115821 | A1 | 5/2013 | Golko et al. | |
| 2013/0143447 | A1 | 6/2013 | He et al. | |
| 2014/0113487 | A1* | 4/2014 | Chen et al. | 439/607.01 |
| 2014/0179145 | A1* | 6/2014 | Zhang | 439/357 |
| 2014/0187097 | A1* | 7/2014 | Yokoyama et al. | 439/660 |

FOREIGN PATENT DOCUMENTS

| | | | |
|---|---|---|---|
| WO | 2006/065681 | A1 | 6/2006 |
| WO | 2011/150403 | A1 | 12/2011 |

OTHER PUBLICATIONS

Response to Non-Final Office Action for U.S. Appl. No. 14/050,047, filed on Apr. 16, 2014, 13 pages.

Notice of Allowance received for U.S. Appl. No. 14/050,047, mailed on Apr. 28, 2014, 12 pages.

Notice of Allowance received for U.S. Appl. No. 14/104,294, mailed on Mar. 21, 2014, 8 pages.

International Search Report and Written Opinion Received received for PCT Patent Application No. PCT/US2014/010050, mailed on Mar. 28, 2014, 15 pages.

"Apple Connector", May 15, 2013, 1 page.

"Apple is Granted 6 MacBook Pro Design Patents in Hong Kong—Patently Apple", available online at <www.patentlyapple.com/patently-apple/2013/04/apple-is-granted-6-macbook-pro-design-patents-in-hong-kong.htm>, retrieved on Apr. 16, 2013, 9 pages.

"Apple Lightning", May 15, 2013, 1 page.

"Apple Mag-Safe Adapter", Apr. 12, 2013, 1 page.

"Bare PCB Test Probes", Datasheet, Feb. 16, 2012, 1 page.

"DisplayPort", from Wikipedia, the free encyclopedia, retrieved on Sep. 4, 2013, 13 pages.

"HDMI", from Wikipedia, the free encyclopedia, retrieved on Sep. 4, 2013, 30 pages.

"MacBook Pro (Retina, 15-inch, Early 2013)—Technical Specifications", Mar. 19, 2013, 4 pages.

"Micro USB Plug", May 15, 2013, 1 page.

Schock, Jason, "How to Fix a Wobbly Macbook Pro Screen", available online at <schock.net/articles/2012/02/20/how-to-fix-a-wobbly-macbook-pro-screen/>, Feb. 20, 2012, 4 pages.

Non-Final Office Action for U.S. Appl. No. 13/946,783, mailed Apr. 8, 2015, 16 pages,

* cited by examiner

ELECTRICAL CONNECTOR

CROSS-REFERENCE TO RELATED APPLICATION

This application is a Continuation of, and claims priority to, U.S. patent application Ser. No. 14/050,047, filed on Oct. 9, 2013, entitled "ELECTRICAL CONNECTOR", the disclosure of which is incorporated by reference herein in its entirety.

TECHNICAL FIELD

This description relates to electrical connectors for transmitting data and/or power.

BACKGROUND

Electrical connectors can transmit data and/or power to computing devices. The computing devices may include portable computing devices such as laptop or notebook computers, tablets, or netbooks, may include smartphones, or may include desktop computers.

After the electrical connector is inserted into the portable computing device, a person may accidentally trip over or otherwise apply force to the electrical connector. The force may pull the computing device off of a table and cause the computing device to fall onto the floor and become damaged, or the force may cause damage to the electrical connector and/or a socket of the computing device that receives the electrical connector.

SUMMARY

According to an example implementation, an electrical connector may include at least one latch that enters an aperture of a computing device, thereby securing the electrical connector within the computing device.

According to another example implementation, a computing device may include a socket with at least one aperture to receive a latch of an electrical connector, thereby securing the electrical connector within the computing device.

According to another example implementation, an electrical connector may include at least one aperture for receiving a latch of an electrical receptacle, thereby securing the electrical connector within the electrical receptacle.

According to another example implementation, a computing device may include a socket with a latch module, the latch module including at least one arm and latch for engaging an electrical connector, thereby securing the electrical connector within the computing device.

According to one general aspect, an electrical connector may include an electrical cord comprising a plurality of wires, and a plug connected to the electrical cord. The plug may include electrical contacts coupled to the plurality of electrical wires, and at least one latch. The at least one latch may be biased to extend away from the plug, an end surface of the at least one latch being within two tenths of a millimeter of an end surface of the plug opposite from the electrical cord.

According to another general aspect, a Universal Serial Bus (USB) receptacle may include a shell defining a recessed area, the shell comprising at least one aperture extending from the recessed area to outside the shell, a tongue extending into the recessed area defined by the shell, the tongue including at least one chamfered corner, and a plurality of electrical contacts extending along the tongue.

According to another general aspect, an electrical connector may include an electrical cord comprising a plurality of wires, a housing enclosing the plurality of wires, a tongue extending from the housing, at least one corner of the tongue being chamfered, and a plurality of electrical contacts extending along at least one surface of the tongue, the plurality of electrical contacts being coupled to the plurality of wires.

According to another general aspect, a Universal Serial Bus (USB) receptacle may include a structural core including a top portion and opposing side portions defining a recessed portion, a plurality of electrical contacts extending from the top portion of the structural core into the recessed portion, and a latch module. The latch module may include a central portion extending across the structural core, and at least one arm extending along one of the side portions of the structural core, the at least one arm including a V-shaped latch extending beyond one of the opposing side portions and into the recessed portion.

The details of one or more implementations are set forth in the accompanying drawings and the description below. Other features will be apparent from the description and drawings, and from the claims.

DETAILED DESCRIPTION

Figure 1A:
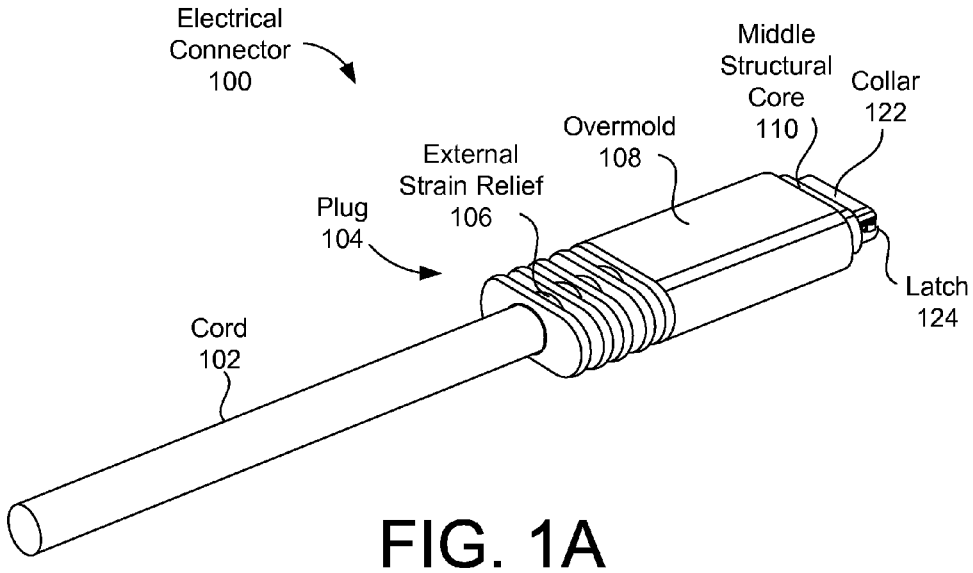
FIG. 1A is a diagram of an electrical connector according to an example embodiment.

FIG. 1A is a diagram of an electrical connector 100 according to an example embodiment. The electrical connector 100 may transmit power and/or data from an external source to a computing device. In one example embodiment, the electrical connector 100 may transmit power from an electrical outlet in a wall to the computing device. In another example embodiment, the electrical connector 100 may form an end portion and/or a plug-in for a connector that transmits data according to a transmission protocol, such as Universal Serial Bus (USB). The electrical connector 100 may also form an adaptor for a connector, receiving a first interface according to a first protocol at one end, and coupling to a computing device with a second interface according to a second protocol at an opposite end. The electrical connector 100 may also form a transmission interface itself. The electrical connector 100 may fit into an electrical socket of the computing device securely, so that the electrical connector 100 does not inadvertently fall out of the electrical socket, but can be moved out of the socket if accidentally tripped over or pushed, preventing the electrical connector 100 from pulling the computing device off of a table and/or preventing damage to the electrical connector and/or socket.

The electrical connector 100 may include an electrical cord 102 and a plug 104. The cord 102 may include a plurality of electrical wires. The cord 102 may, for example, enclose the plurality of electrical wires with an insulator such as a plastic or rubber tube. The electrical wires within the cord 102 may carry and/or transmit electrical power and/or signals. The electrical wires may, for example, include a plurality of electrical wires that each carry electrical signals and collectively carry signals according to a USB protocol.

The plug 104 may be connected to the cord 102. The plug 104 may receive the electrical wires, couple the electrical wires to electrical contacts, and create an interface to couple the electrical contacts of the electrical connector 100 to electrical contacts of a socket.

The plug 104 may include a middle structural core 110. The middle structural core 110 may enclose an inner structural core (not shown in FIG. 1A). The middle structural core 110 may be oval-shaped, or may include opposing long flat regions adjacent to opposing short rounded regions. The middle structural core 110 may enclose components of the electrical connector 100, and may form a backstop for the plug 104, preventing the plug 104 from being inserted into the receptacle beyond a desired depth.

The plug may also include a collar 122. The collar 122 may enclose the inner structural core, which includes the electrical contacts that allow transmission of electrical signals from the wires inside the cord 102 to the computing device into which the electrical connector 100 is inserted. The collar 122 may be made of metal or other rigid material. The collar 122 may be grounded to prevent electrical shock.

The electrical connector 100 may include one or more latches 124. The one or more latches 124 may extend laterally out of the plug 104 and be received by an aperture defined by a socket of the computing device which receives the electrical connector 100. The one or more latches 124 may extend through one or more apertures of the collar 122.

The plug 104 may include an external strain relief 106 and an overmold 108. The external strain relief 106 may be flexible, and may allow the electrical connector 100 to bend without damaging the components such as the electrical wires and/or electrical contacts. The external strain relief 106 may, for example, include ribs that alternate with recessed regions or slots, enhancing flexibility of the strain relief 106 and/or overmold 108 and allowing the plug 104 to bend. The overmold 108 may be rigid, preventing the plug 104 from bending in the area of the overmold and thereby protecting internal components of the plug 104 from damage. The overmold 108 and the external strain relief 106 may be made of non-conductive materials or insulators, such as plastic or rubber.

Figure 1B:
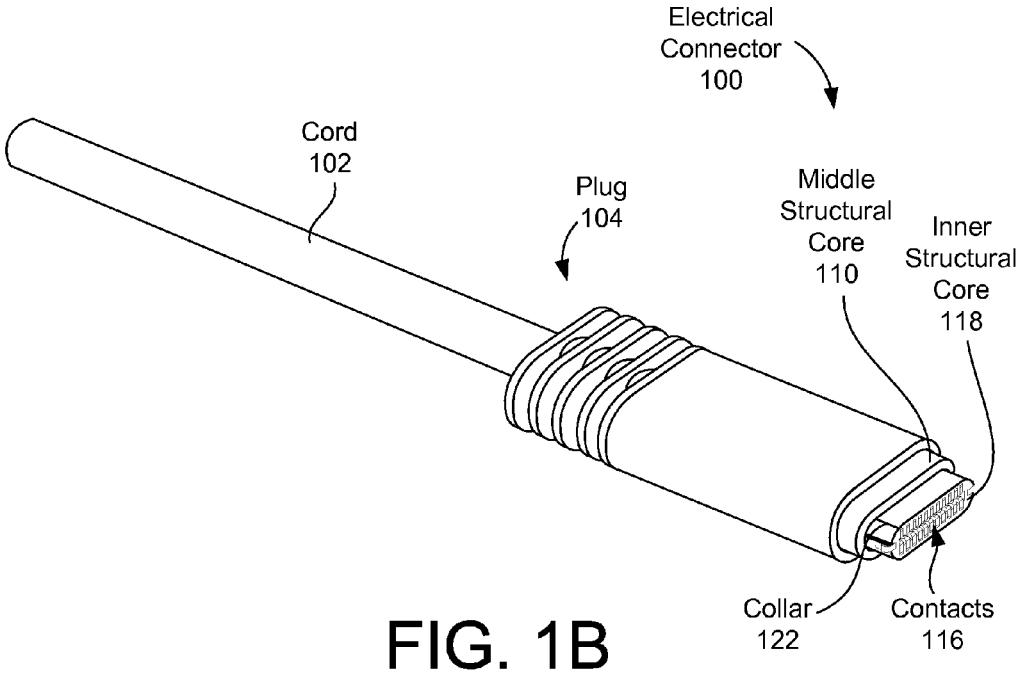
FIG. 1B is another diagram of the electrical connector according to an example embodiment.

FIG. 1B is another diagram of the electrical connector 100 according to an example embodiment. FIG. 1B shows the inner structural core 118. The inner structural core 118 may be made of a rigid, insulative and/or non-conductive material, such as plastic. The inner structural core 118 may include a plurality of tunnels 140 (shown in FIGS. 1C, 1D, and 1H) that receive the electrical contacts 116, and through which the electrical contacts 116 extend. The electrical contacts 116 may be coupled to the electrical wires included in the cord 102. The electrical contacts 116 may pass through the tunnels, and the tunnels may fix the positions of the electrical contacts 116 with respect to each other, preventing the electrical contacts 116 from contacting each other and defining the geometrical arrangement of the electrical contacts 116 so that the electrical contacts 116 will physically contact, and electrically couple to, electrical contacts of the socket.

Figure 1C:
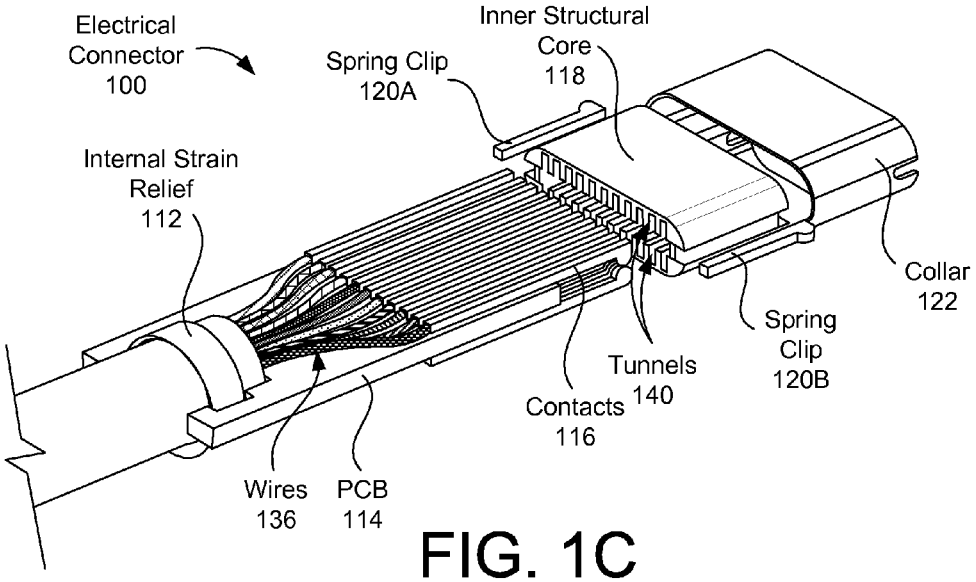
FIG. 1C is a diagram showing the electrical connector in disassembled form according to an example embodiment.

FIG. 1C is a diagram showing the electrical connector 100 in disassembled form, without the overmold 108 and middle structural core 110, according to an example embodiment. The plug 104 may include an internal strain relief 112. The internal strain relief 112 may compliment the external strain relief 106 shown in FIG. 1A. The internal strain relief 112 may include, for example, a collar or band which protects the cord 102. The internal strain relief 112 may be made of a rigid material, such as plastic or metal. The internal strain relief 112 may hold the cord 102 in a fixed position with respect to a printed circuit board (PCB) 114, preventing pressure on the cord 102 from causing the electrical wires 136 from moving with respect to the PCB 114.

The plug 104 may include the printed circuit board PCB 114. The PCB 114 may include the electrical contacts 116 which extend through the inner structural core 118.

The FIG. 1C also shows the spring clips 120A, 120B, which may include the latch 124 shown in FIG. 1A. The spring clips 120A, 120B may be in the shape of a lowercase 'd', with an elongated portion or stem at one end, and a thicker portion at an opposite end extending away from the elongated portion and away from the plug 104. The spring clips 120A, 120B may be made of a rigid material, such as metal or plastic. The spring clips 120A, 120B may lay in slots on opposite sides of the inner structural core 118. The spring clips 120A, 120B may be fixed in place within the slots under the overmold 108. The spring clips 120A, 120B, when fixed under the overmold 108, may be biased away from the plug and the electrical connector 100, so that the spring clips 120A, 120B are biased to extend outward, and latch into an aperture of a receptacle of the computing device.

The plug 104 may also include a collar 122. The collar 122 may enclose the inner structural core 118 and the spring clips 120.

Figure 1D:
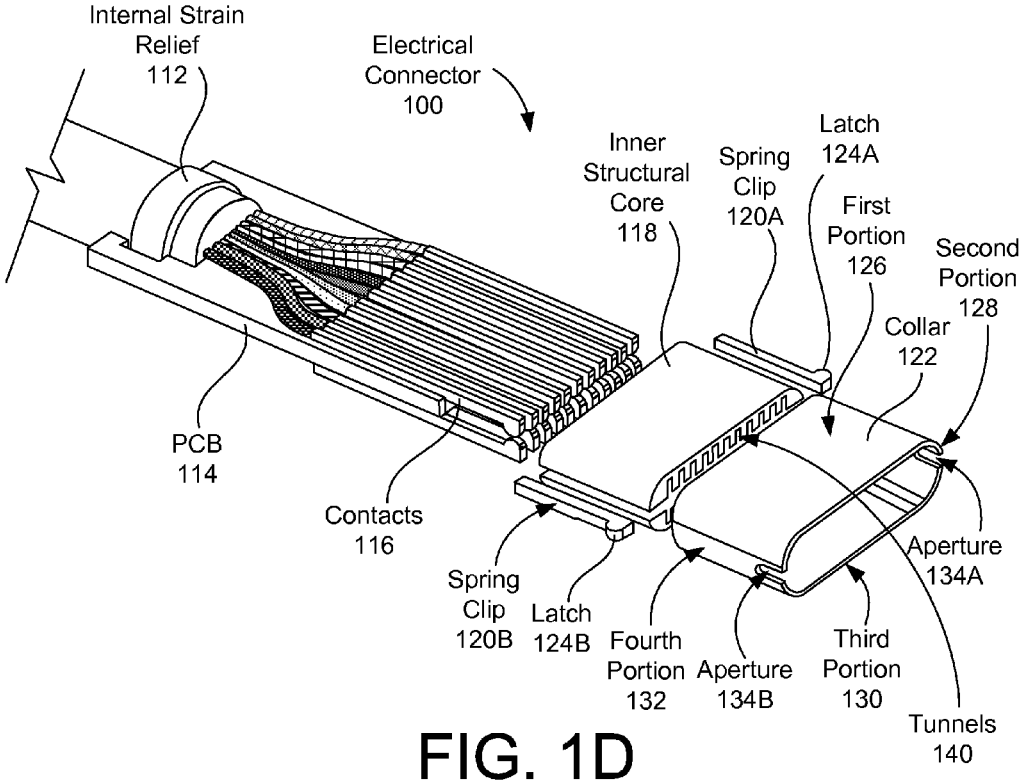
FIG. 1D is another diagram showing the electrical connector in disassembled form according to an example embodiment.

FIG. 1D is another diagram showing the electrical connector 100 in disassembled form, without the overmold 108 and middle structural core 110, according to an example embodiment. As shown in FIG. 1D, the spring clips 120A, 120B may each include a latch 124A, 124B extending laterally from the respective spring clip 120A, 120B at an end of the spring clip 120A, 120B that is distal to the electrical connector 100. The latches 124A, 124B may extend away from the spring clips 120A, 120B for a distance approximately equal to a width of the elongated portion of the spring clips 120A, 120B. The latches 124A, 124B may, for example, extend away from the spring clips 120A, 120B a distance between one-half and twice a width of the elongated portion of the spring clips 120A, 120B.

The collar 122 may be oval-shaped, and/or made of a first pair of opposing sides that are relatively long and flat and a second pair of opposing sides that are relatively long and rounded. In this example, the collar 122 may be made of a first portion 126 that is generally flat. The collar 122 may also include a second portion 128 that is semi-circular or rounded. The second portion 128 may be adjacent to the first portion 126. The collar 122 may also include a third portion 130 adjacent to the second portion 128. The third portion 130 may be generally flat. The third portion 130 may be opposite from the first portion 126. The collar 122 may also include a fourth portion 132. The fourth portion 132 may be adjacent to both the first portion 126 and the third portion 130. The fourth portion 132 may be opposite from the second portion 128. The fourth portion 132 may be semicircular or rounded.

The second and fourth portions 128, 132 of the collar 122 may each include an aperture 134A, 134B. The apertures 134A, 134B may, for example, include slots or holes which allow the latches 124A, 124B to extend from inside the collar 122 to outside the collar 122. The apertures 134A, 134B may be at end portions of the second and fourth portions 128, 132 opposite from the wires 136 and/or cord 102. A thickness of the collar 122 may be less than a distance by which the latches 124A, 124B extend away from their respective spring clips 120A, 120B, thereby allowing the latches 124A, 124B to extend out of the apertures 134A, 134B and beyond an outer surface of the collar 122. The middle structural core 110 PCB 114, inner structural core 118, spring clips 120A, 120B, and/or collar 122 may be considered a structure that supports the contacts 116.

Figure 1E:
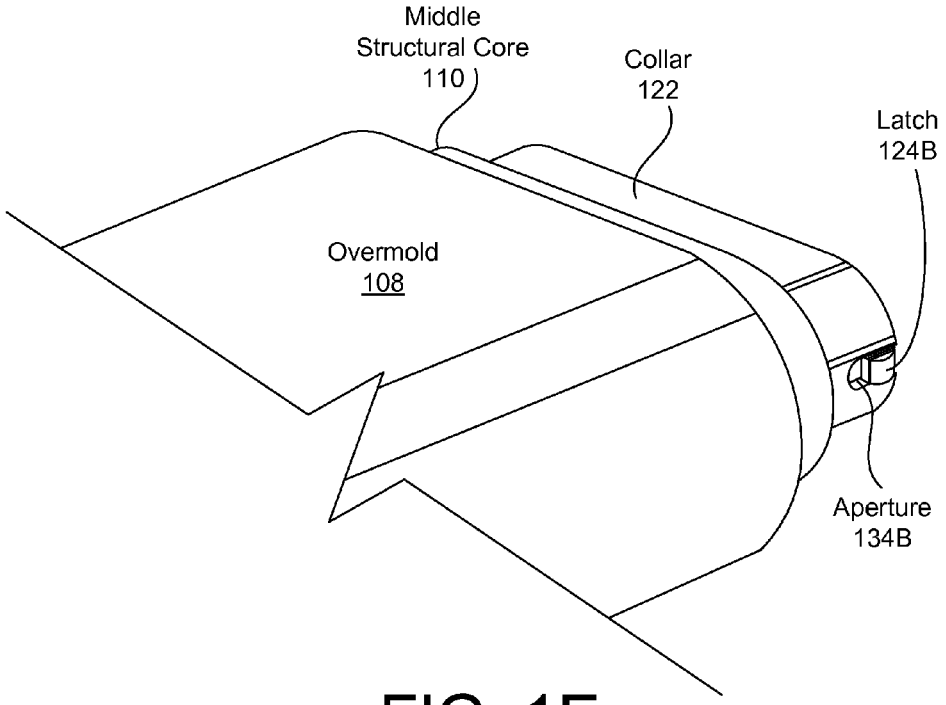
FIG. 1E is a diagram showing an end portion of the electrical connector according to an example embodiment.

FIG. 1E is a diagram showing an end portion of the electrical connector 100 according to an example embodiment. FIG. 1E shows the collar 122 surrounding the inner structural core 118 (not labeled in FIG. 1E). FIG. 1E also shows the latch 124B extending through the aperture 134B of the collar 122, and beyond the outer surface of the collar 122.

Figure 1F:
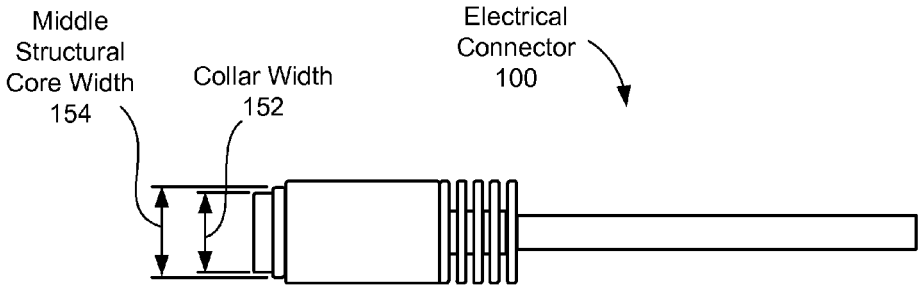
FIG. 1F is a diagram showing dimensions of the electrical connector according to an example embodiment.

FIG. 1F is a diagram showing dimensions of the electrical connector 100 according to an example embodiment. In this example, a collar width 152, or width of the collar 122 (not labeled in FIG. 1F), may be less than a middle structural core width 154, or width of the middle structural core 110 (not labeled in FIG. 1F). The collar width 152 may correspond to a distance between the second and fourth portions 128, 132 of the collar 122 shown in FIG. 1D. In an example implementation, the collar width 152 may be between nine and ten millimeters, and/or between eighty-five and ninety-five percent of the middle structural core width 154, between eighty-five and ninety percent of the middle structural core width 154, or between ninety and ninety-five percent of the middle structural core width 154. In an example embodiment, the middle structural core width 154 may be between ten and eleven millimeters.

Figure 1G:
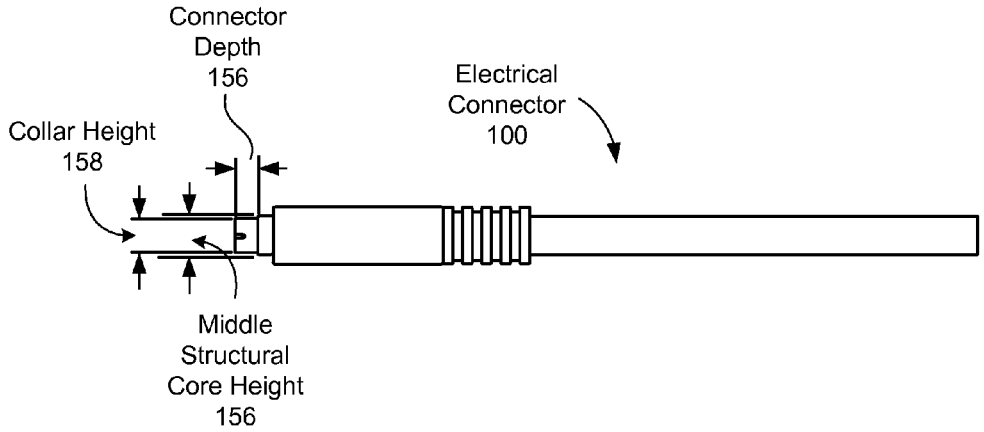
FIG. 1G is another diagram showing dimensions of the electrical connector according to an example embodiment.

FIG. 1G is another diagram showing dimensions of the electrical connector 100 according to an example embodiment. A connector depth 156, or extent by which the inner structural core 120 (not labeled in FIG. 1G), the collar 122 (not labeled in FIG. 1G), and the contacts 118 (not labeled in FIG. 1G), extend beyond the middle structural core 110 (not labeled in FIG. 1G), may be between two and two-and-a-half millimeters, and/or half, or between fifty and sixty percent, of a middle structural core height 156. The middle structural core height 156, or height of the middle structural core 110 (not labeled in FIG. 1G), may be between 3.5 and 4.5 millimeters, and/or less than half the middle structural core width 154 (labeled in FIG. 1F). A collar height 158 may be between 2.5 and 3.5 millimeters and/or greater than the connector depth 156. The collar height 158 may correspond to a distance between the first and third portions 126, 130 of the collar 122 shown in FIG. 1D. The middle structural core height 156 and collar height 158 shown in FIG. 1G may correspond to distances between outer portions of the middle structural core 110 and collar 122, respectively.

Figure 1H:
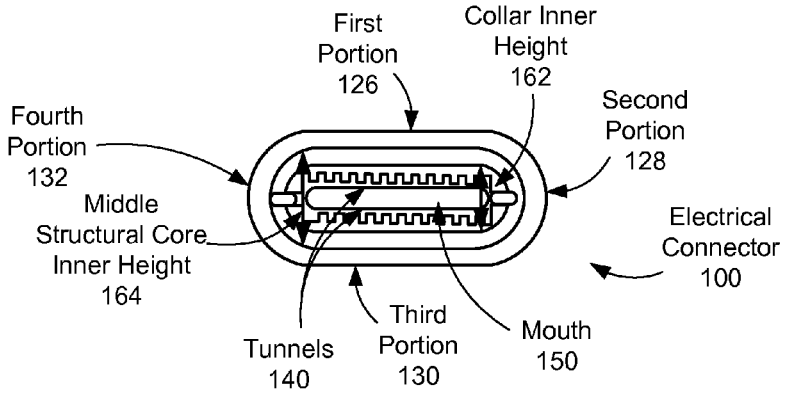
FIG. 1H is another diagram showing dimensions of the electrical connector according to an example embodiment.

FIG. 1H is another diagram showing dimensions of the electrical connector 100 according to an example embodiment. A collar inner height 162, or distance between inner portions of the middle structural core 110 (not labeled in FIG. 1G), may be between 1.5 and 2.5, and/or less than the connector depth 156 (labeled in FIG. 1G). A middle structural core inner height 164, or distance between inner portions of the first and third portions 126, 130 of the collar 122, may be between one and two millimeters and/or less than the connector depth 156, but greater than the collar inner height 162.

Figure 1I:
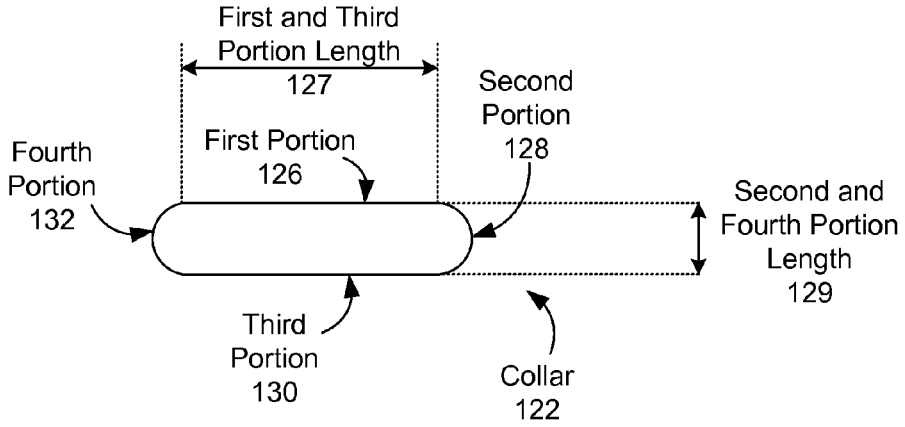
FIG. 1I is a diagram showing dimensions of a collar included in the electrical connector according to an example embodiment.

FIG. 1I is a diagram showing dimensions of the collar 122 according to an example embodiment. The first portion 126 may have approximately a same width or length as the third portion 130, denoted a first and third portion length 127. The second portion 128 may have approximately a same width or length as the fourth portion 132, denoted a second and fourth portion length 129. The second and fourth portion length 129 may be measured as a distance between end portions of the adjacent first portion 126 and third portion 130, as shown in FIG. 1I, or as a perimeter around the rounded second portion 128 and fourth portion 132. The first and third portion length 127 may be at least twice the second and fourth portion length 129.

Figure 1J:
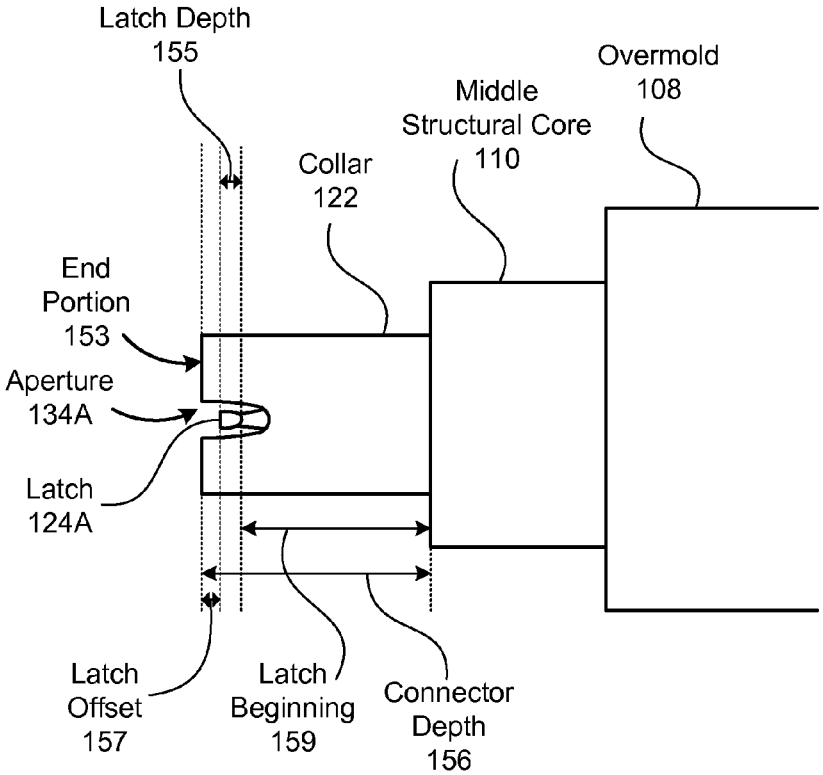
FIG. 1J is a diagram showing a location and dimensions of a latch with respect to other components of the electrical connector according to an example embodiment.

FIG. 1J is a diagram showing a location and dimensions of a latch 124A with respect to other components of the electrical connector according to an example embodiment. The latch 124B (not shown in FIG. 1I) may have a similar location and/or dimensions to the latch 124A on an opposite side of the collar 122. The latch 124A may have a latch depth 155 which is less than the connector depth 156. The latch depth 155 may be measured in a direction parallel to a direction in which the collar 122 extends from the middle structural core 110 and/or overmold 108. The latch depth 155 may measure a depth of the portion of the latch 124A that extends from the spring clip 120A (not labeled in FIG. 1J) and/or beyond the collar 122. The latch depth 155 may, for example, be less than half of the connector depth 156, or less than one-fourth the connector depth 156, according to example embodiments.

The latch 124A may be located at or near an end surface 153 of the collar 122. The end surface 153 may be distal to the middle structural core 110 and/or overmold 108. The location of the latch 124 at or near the end surface 153 may minimize the extension of the collar 122 into the receptacle (not shown in FIG. 1I). The reduced extension of the collar 122 into the receptacle may enable the collar 122 to rotate out of the receptacle, without damage to either the receptacle or components of the electrical connector, when the electrical connector is pulled sideways.

A latch offset 157 may represent a distance from the end surface 153 of the collar 122 to the latch 124A. The latch offset 157 may be relatively small compared to the connector depth 156, and may be zero in an example in which the latch 124A is flush with the end surface 153. The open end of the aperture 134A at the end portion 153 of the collar 122 may enable the small latch offset 157. The latch offset 157 may, for example, be less than one-tenth or one-twentieth of the connector depth 156, according to example embodiments. The latch offset 157 may be less then two-tenths of a millimeter, less than one-tenth of a millimeter, or zero, according to example embodiments. The latch 124A may extend from, or be located in, a most distal quarter or half of the collar 122 from the middle structural core 110; the latch 124A may extend from, or be located in, a portion of the collar that is one-half or one-quarter of the connector depth 156 from the end surface 153. The small latch offset 157 may enable a short connector depth 156 and a relatively small connector depth 156 compared to the collar width 152. The relatively short connector depth 156 may allow the electrical connector 100 to fall out of a socket 302A, 302B (shown in FIGS. 3A, 3B, 4A, 4B, 4C, 4D, 4E, 4F, 4G) without damaging either the connector 100 or socket 302A, 302B or pulling a computing device off of a table.

A latch beginning 159 may represent a distance from a back or proximal portion of the collar 122, and/or a distance from the middle structural core 110, to the latch 124A. The latch beginning 159 may represent a length of a back portion of the collar 122 until a beginning of the latch 124A. The length of the latch beginning 159 may, for example, be at least three-fourths of the connector depth 156.

Figure 2:
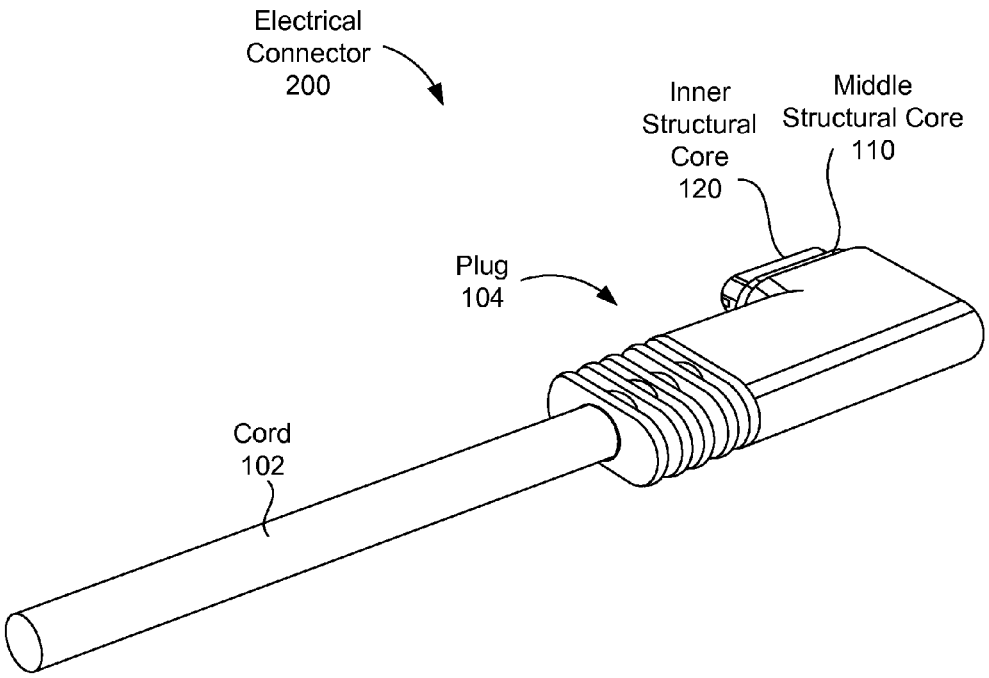
FIG. 2 is a diagram showing an electrical connector according to an example embodiment.

FIG. 2 is a diagram of an electrical connector 200 according to another example embodiment. The electrical connector 200 may have similar features to the electrical connector 100 described above. The electrical connector 200 may also have similar dimensions to those described above with respect to the electrical connector 100 described above. In this example, the electrical connector 200 may be inserted sideways into a socket or receptacle of a computing device. In this example, the inner structural core 120A and middle structural core 110A of the electrical connector 200 shown in FIG. 2 may extend perpendicularly or laterally, to the plug 104.

Figure 3A:
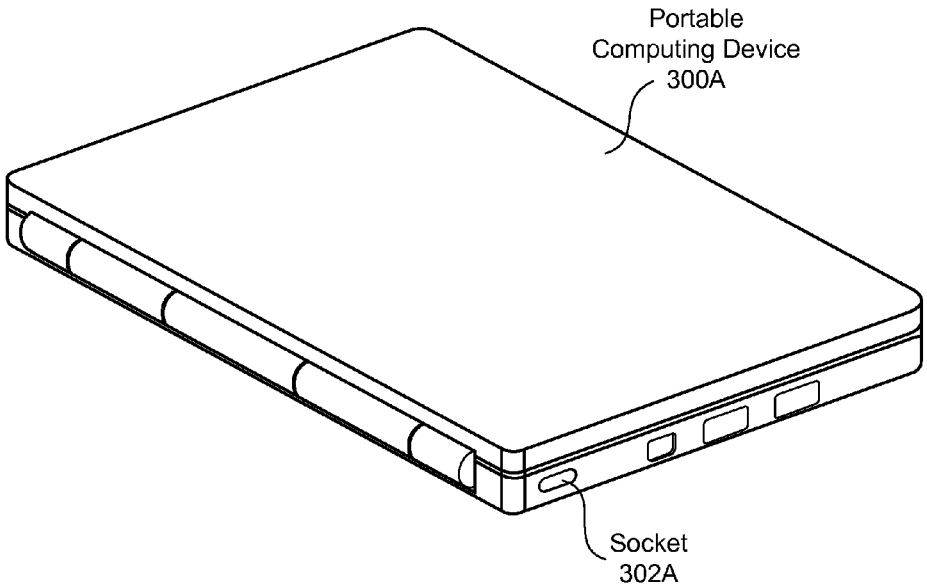
FIG. 3A is a diagram showing a portable computing device according to an example embodiment.

FIG. 3A is a diagram showing a portable computing device 300A according to an example embodiment. The portable computing device 300A may receive electrical power and/or data from either of the electrical connectors 100, 200 described above. In this example, the portable computing device 300A may include a laptop or notebook computer. In this example, the portable computing device 300A may include a socket 302A. The socket 302A, which may receive either of the electrical connectors 100, 200 described above, and may include a USB interface, may be flat and/or flush with a side of the portable computing device 300A, having ends that terminate at a common plane. The socket 302A may also have a relatively short depth compared to a width of the socket, with similar dimensions and/or ratios to the electrical connector 100 described above.

Figure 3B:
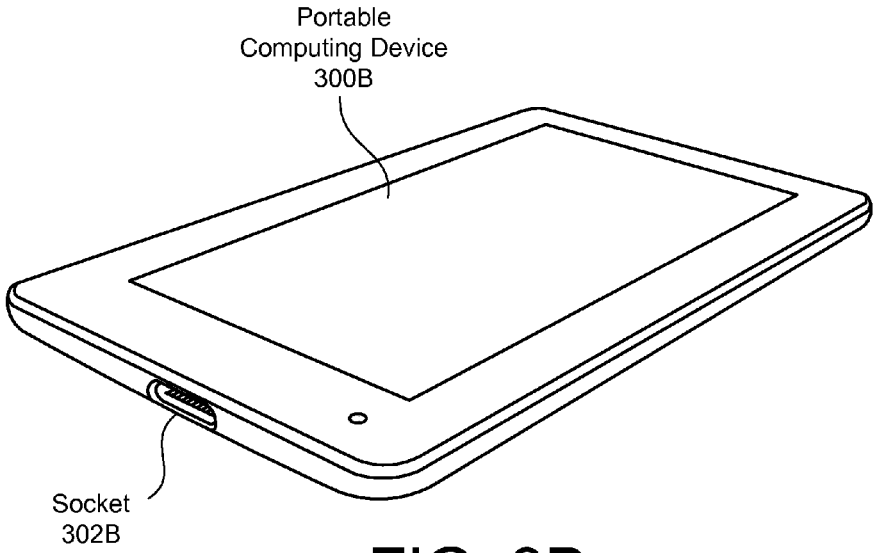
FIG. 3B is a diagram showing a portable computing device according to another example embodiment.

FIG. 3B is a diagram of a portable computing device 300B according to another example embodiment. In this example, the portable computing device 300B may include, for example, a tablet computer with rounded edges. In this example, the socket 302B may be rounded or tapered. The socket 302B may otherwise have similar features to the socket 302A.

Figure 4A:
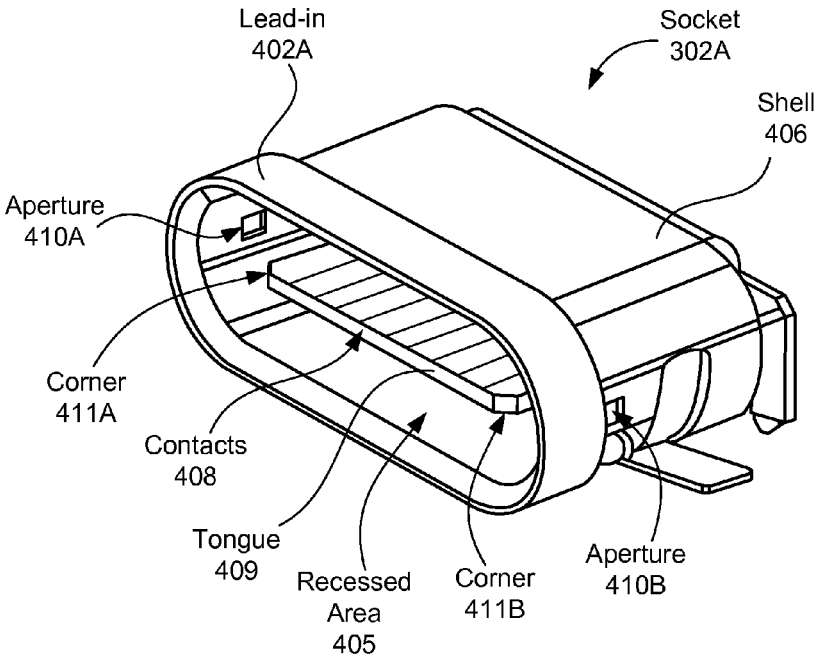
FIG. 4A is a diagram showing an electrical socket according to an example embodiment.

FIG. 4A is a diagram showing an electrical socket 302A according to an example embodiment. The electrical socket 302A may receive the electrical connector 100, 200 shown and described with respect to the FIGS. 1A-1H and/or FIG. 2. The socket 302A may include a shell 406. The shell 406 may be elliptical, or may include flat top and bottom portions and rounded left and right portions, similar to the collar 122 described above, and may be configured to receive the collar 122. The shell 406 and/or a structural core 404 (labeled in FIG. 4E) may define a cavity or recessed area 506 that receives the plug 104 of the electrical connector 100, 200. The shell 406 may be made of a rigid material, such as metal or plastic.

The socket 302A may also include a lead-in 402A which surrounds the cavity or recessed area 405 of the socket 302A. The lead-in 402A may surround an end portion of the shell 406, or a portion of the shell 406 that is distal from the computing device 300A. The lead-in 402A may have a similar shape to the shell 406, and a distal portion of the lead-in 402A may be flat or flush. The lead-in 402A may be made of a rigid material such as plastic or metal. The lead-in 402A may be colored to correspond to a color of the computing device 300A, or to contrast with a color of the computing device 300A.

The socket 302A may include a tongue 409 which extends into the cavity or recessed area 405 defined by the shell 406 and/or structural core 404. The tongue 409 may extend into or along a central axis of the cavity or recessed area 405. Electrical contacts 408 may be located on a top and/or bottom of the tongue 409. When the electrical connector 100 or electrical connector 200 is inserted into the cavity of the socket 302A, the tongue 409 may enter the mouth 150 (shown in FIG. 1H) of the connector 100, 200, and the electrical contacts 116 of the electrical connector 100, 200 may engage the contacts 408, enabling the contacts 408 to carry the signals and/or power from the electrical connector 100 to the computing device 300A.

Distal corners 411A, 411B, or corners 411A, 411B or the tongue 409 closest to an opening of the socket 302A and/or farthest from a backstop (shown in FIG. 4G) of the socket 302A may be tapered, curved, chamfered and/or cutout. The tapered, curved, and/or chamfered cutout shape of the corners 411A, 411B may allow the tongue 409 to rotate out of the tunnels 140 (shown in FIGS. 1C, 1D, and 1H) of the plug 104 without damaging the plug 104 or socket 302A.

The shell 406 may also define apertures 410A, 410B. The apertures 410A, 410B may be on the rounded or short right and left portions of the shell 406. The apertures 410A, 410B may receive the latches 124A, 124B of the electrical connector 100, thereby securing the electrical connector 100 within the socket 302A. The apertures 410A, 410B may be in a back portion of the cavity defined by the shell 406 of the socket 302A. The apertures 410A, 410B may, for example, be in a back or bottom half, or back or bottom quarter of the cavity.

Figure 4B:
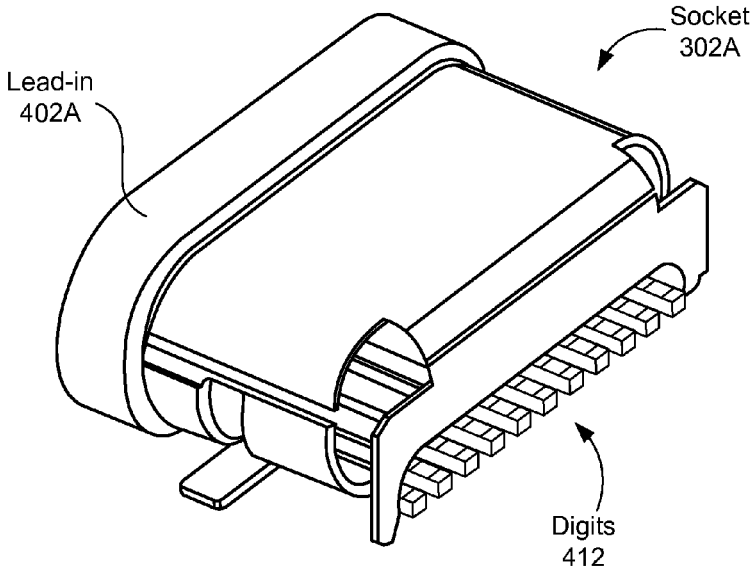
FIG. 4B is another diagram showing the electrical socket of FIG. 4A according to an example embodiment.

FIG. 4B is another diagram showing the electrical socket 302A of FIG. 4A according to an example embodiment. The socket 302A may include digits or fingers 412 on a back of the socket 302A, or a portion of the socket 302A that is proximal to the computing device 300A. The digits or fingers 412 may engage corresponding digits or fingers inside the portable computing device 302A, thereby securing the socket 302A within the portable computing device 300.

Figure 4C:
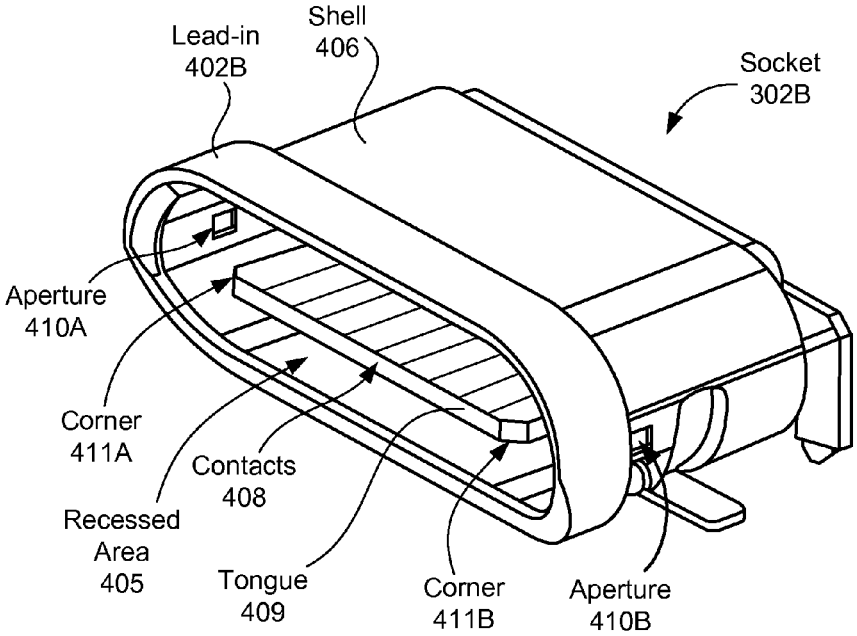
FIG. 4C is a diagram showing an electrical socket according to another example embodiment.
Figure 4D:
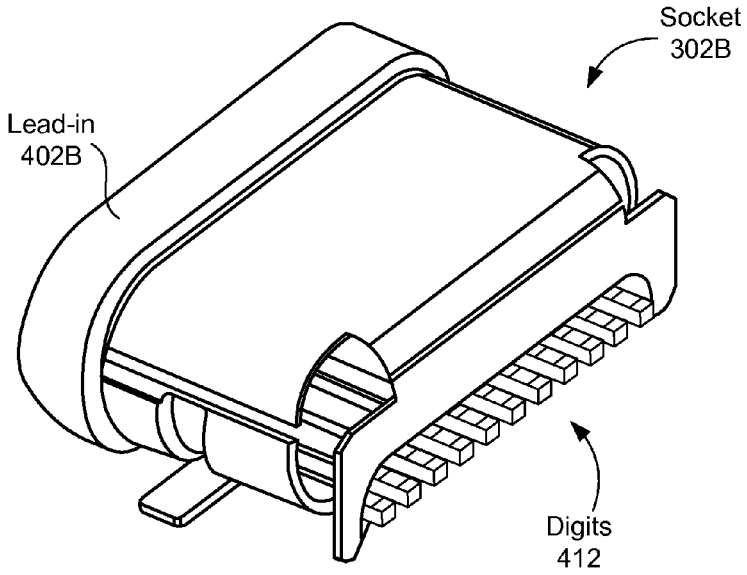
FIG. 4D is another diagram showing the electrical socket of FIG. 4C according to an example embodiment.

FIGS. 4C and 4D are diagrams of an electrical socket 302B according to an example embodiment. The socket 302B shown in FIGS. 4C and 4D is similar to the socket 302A shown in FIGS. 3A and 3B, except that the shell 406 and/or lead-in 402B is tapered. The tapering of the shell 406 and/or lead-in 402B may cause a top of the lead-in 402B to extend farther away from the shell 406 and/or computing device 300B than a bottom of the lead-in 402B. The tapering of the shell 406 and/or lead-in 402B may correspond to a tapered or curved shape of the side of the portable computing device 300B, allowing the side of the portable computing device 300B to maintain the tapered or curved shape along the electrical socket 302B. The tongue 409 may have tapered, curved, and/or cutout corners 411A, 411B in similar fashion to the tongue 409 described above with respect to FIG. 4A.

Figure 4E:
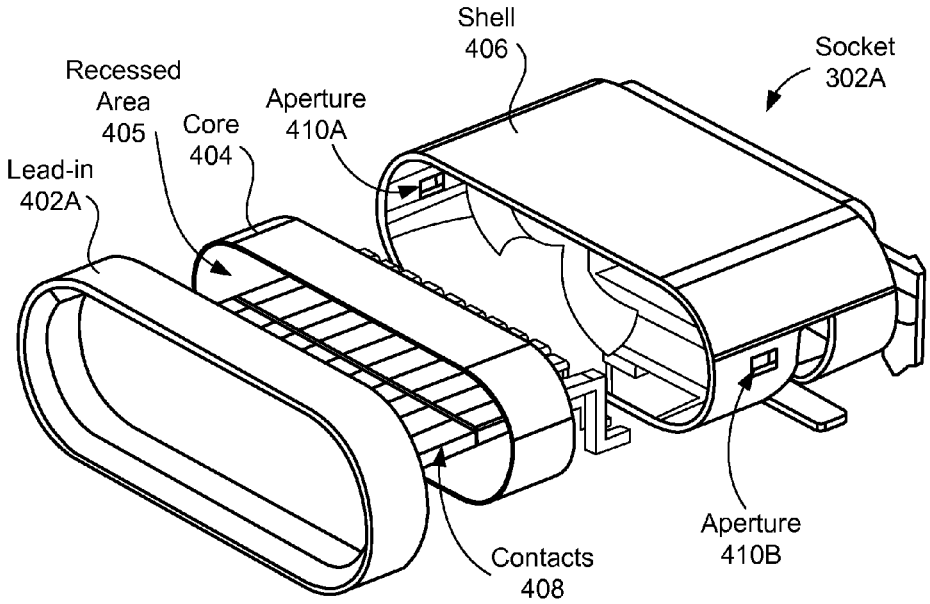
FIG. 4E is a diagram showing an electrical socket in disassembled form according to an example embodiment.
Figure 4F:
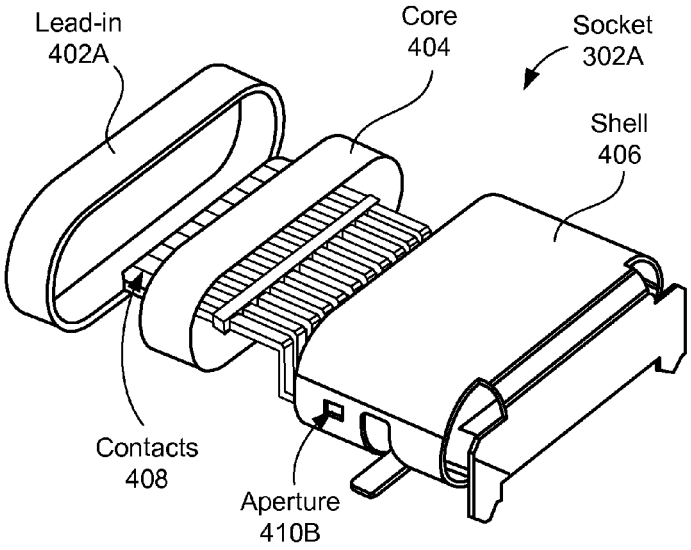
FIG. 4F is another diagram showing the electrical socket in disassembled form according to an example embodiment.

FIGS. 4E and 4F are diagrams showing an electrical socket 302A in disassembled form according to an example embodiment. The components of the electrical socket 302A shown and described with respect to FIGS. 4E, 4F, 4G, 4H, 4I, and 4J may also be included in the electrical socket 302B shown and described with respect to FIGS. 4C and 4D.

The socket 302A may include the lead-in 402A that encloses or slides onto a core 404 and/or the shell 406. The core 404 may be elliptical, or may include relatively longer top or bottom portions that are flat, and relatively shorter right and left portions that are curved or semi-circular. The shape of the core 404 may correspond to the shape of the collar 122 described above. The core 404 may also include the contacts 408 that extend into the cavity defined by the shell 406. The core 404 and/or shell 406 may define the cavity or recessed area 405. The core 404 may be secured inside the shell 406. The shell 406 may include the apertures 410A, 410B.

Figure 4G:
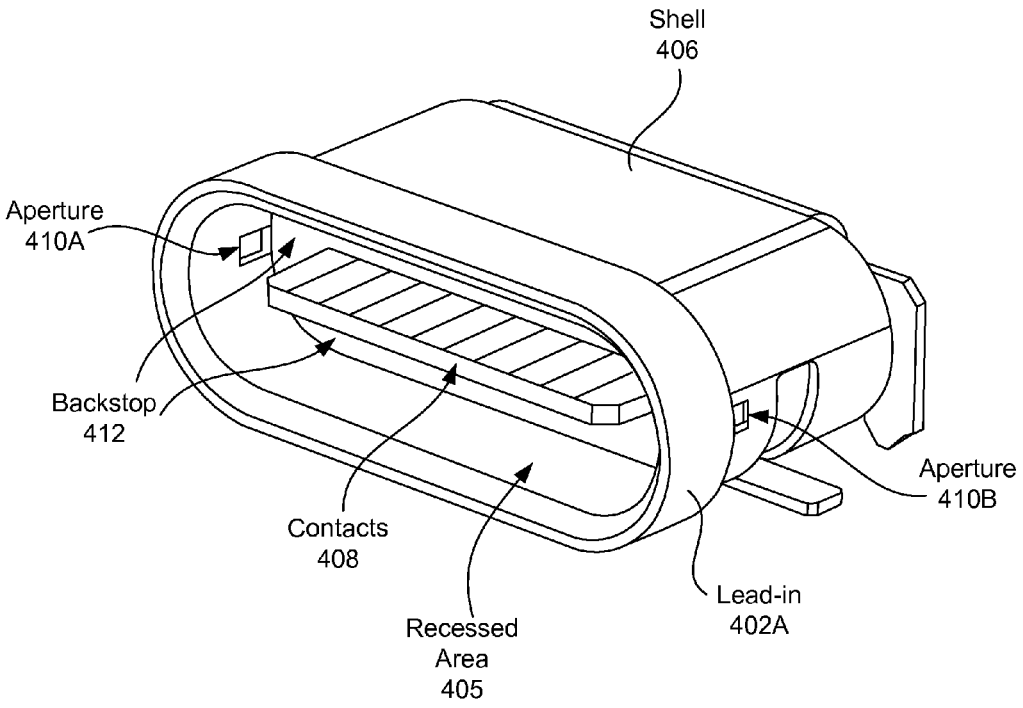
FIG. 4G is a diagram showing an electrical socket according to an example embodiment.

FIG. 4G is another diagram showing the electrical socket 302A according to an example embodiment. In this example, the shell 406 may include a vertical portion forming a backstop 412. The backstop 412 may be perpendicular to the top and bottom portions of the shell 406. The backstop 412 may define a bottom of the cavity of the socket 302A which receives the electrical connector 100. The apertures 410A, 410B may be in a bottom half or bottom quarter of the cavity. The apertures 410A, 410B may, for example, be flush with the backstop 412 of the socket 302A. The apertures 410A, 410B may be circular, square, or any other appropriate shape to receive the latches 124A, 124B (not shown in FIG. 4G).

Figure 4H:
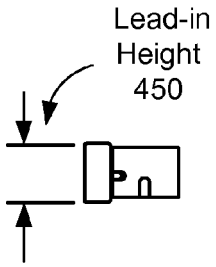
FIG. 4H is a diagram showing dimensions of an electrical socket according to an example embodiment.

FIG. 4H is a diagram showing dimensions of the electrical socket 302A, 302B according to an example embodiment. In an example embodiment, a lead-in height 450, or height of the lead-in 402A, 402B from opposing flat portions, may be between 3.5 and 4.5 millimeters measured from outer portions of the lead-in 402A, 402B.

Figure 4I:
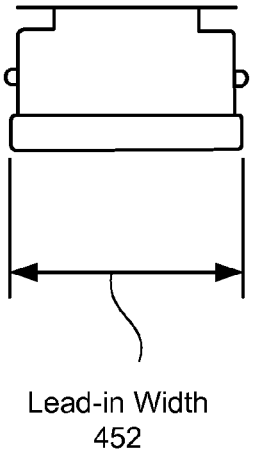
FIG. 4I is another diagram showing dimensions of an electrical socket according to an example embodiment.

FIG. 4I is a diagram showing dimensions of the electrical socket 302A, 302B according to an example embodiment. A lead-in width 452, or width of the lead-in 402A, 402B from opposing rounded or semicircular portions, may be between ten and eleven millimeters, and/or at least twice the lead-in height 450.

Figure 4J:
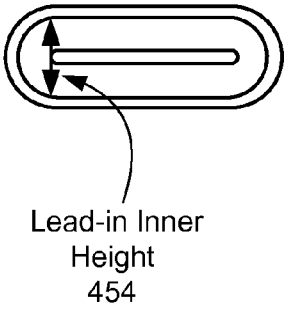
FIG. 4J is another diagram showing dimensions of an electrical socket according to an example embodiment.

FIG. 4J is a diagram showing dimensions of the electrical socket 302A, 302B according to an example embodiment. In this example, a lead-in inner height 454 may be a distance between inner portions of the opposing flat portions of the lead-in 402A, 402B, and may be between 1.5 and 2.5 millimeters. In an example embodiment, the lead-in width 452 may be at least four times, or at least five times, the lead-in inner height 454.

In the embodiments described in FIGS. 1-4, the electrical connector 100, 200 included latches 124A, 124B, and the socket 302A, 302B included apertures 410A, 410B. The apertures 410A, 410B received the latches 124A, 124B to secure the electrical connector 100 within the socket 302A, 302B. In another example embodiment, a socket may include latches, and an electrical connector may include apertures. The apertures of the electrical connector may receive the latches of the socket to secure the electrical connector within the socket.

Figure 5A:
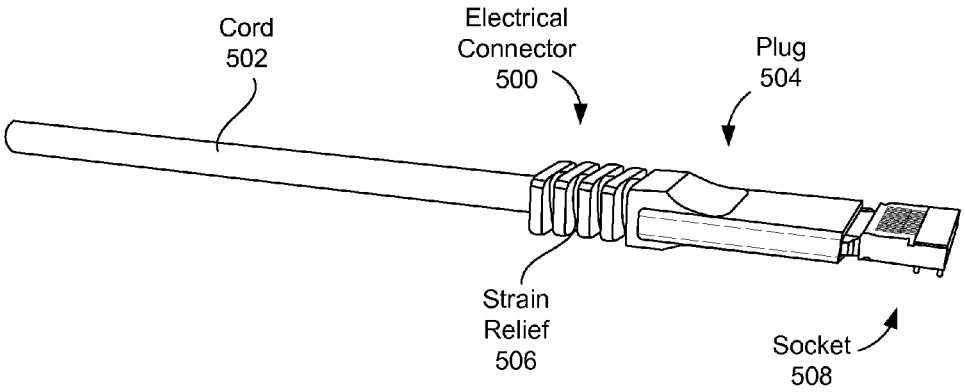
FIG. 5A is a diagram of an electrical connector and socket according to an example embodiment.

FIG. 5A is a diagram of an electrical connector 500 and socket 508 according to an example embodiment. The electrical connector 500 may be inserted into the socket 508. The socket 508 may be part of a portable computing device, such as the portable computing device 300A shown in FIG. 3A or the portable computing device 300B shown in FIG. 3B. The electrical connector 500 and socket 508 may carry and/or transmit signals according to a USB protocol in a similar manner to the electrical connector 100, 200 and socket 302A, 302B described above. The socket 508 may receive a portion of a plug 504 of the electrical connector 500. The socket 508 may include latches, not shown in FIG. 5A, which are received by apertures, not shown in FIG. 5A, of the plug 504, to secure the electrical connector 500 to the socket 508.

The electrical connector 500 may include an electrical cord 502. The cord 502, like the cord 102 described above, may include a plurality of electrical wires (not shown in FIG. 5A). The electrical wires included in the cord 502 may carry electrical power and/or signals. The electrical wires within the cord 502 may be separated from each other by insulative material, such as plastic or rubber tunnels, to prevent crosstalk and/or interference with each other.

The electrical connector 500 may also include a strain relief 506. The strain relief 506 may be made of an elastic material, such as rubber or plastic. The strain relief 506 may include alternating recessed portions of slots and ridges. The elastic material and alternating slots and ridges of the strain relief 506 may allow the electrical connector 500 and/or cord 502 to bend without damaging internal components of the electrical connector 500, such as the electrical wires.

The electrical connector 500 may also include a plug 504. The plug 504 may be connected to the cord 502, and may receive the electrical wires included in the cord 502. The plug 504 may include components of the electrical connector 500, described below.

Figure 5B:
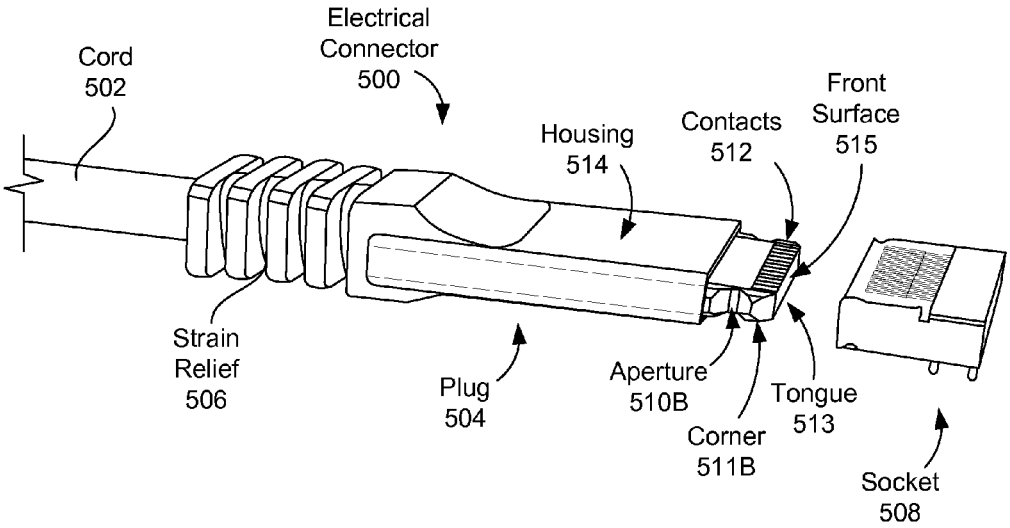
FIG. 5B is a diagram of the electrical connector and socket according to an example embodiment.

FIG. 5B is a diagram of the electrical connector 500 and socket 508 according to an example embodiment. In this example, the plug 504 may include a housing 514. The housing 514 may enclose components of the plug 504 and/or electrical connector 500. The housing 514 may be rectangular, and may be made of a single molded component, or of multiple components connected together. The housing 514 may be made of an insulative material which is rigid enough to protect the components of the plug 504 and/or electrical connector 500, such as plastic.

The plug 504 may include a tongue portion 513 extending from an end of the plug 504 opposite from the strain relief 506 and cord 502. The tongue portion 513 may have a smaller width and/or a small height than the housing 514. Corners 511B (the other corner 511A is labeled in FIGS. 5E and 6A) may be chamfered. The chamfering of the corners 511A, 511B may enable to the tongue 513 to slide into and out of the socket 508. The tongue portion 513 may also define one or more apertures, such as aperture 510B. The aperture 510B may receive a latch (not shown in FIG. 5B) from the socket 508 and thereby secure the tongue portion 513 of the plug 504 within the socket 508.

The tongue portion 513 of the plug 506 may include contacts 512 on a top and/or bottom of the tongue portion 513. The contacts 512 may extend to or near a front surface 515 of the tongue 513. The contacts 512 may be made of an electrically conductive material, such as copper, aluminum, gold, or silver. The contacts 512 may be coupled to the electrical wires within the cord 502, and may couple to corresponding contacts of the socket 508. The contacts 512 may allow the electrical wires from the cord 502 to communicate with the portable computing device via the socket 508.

Figure 5C:
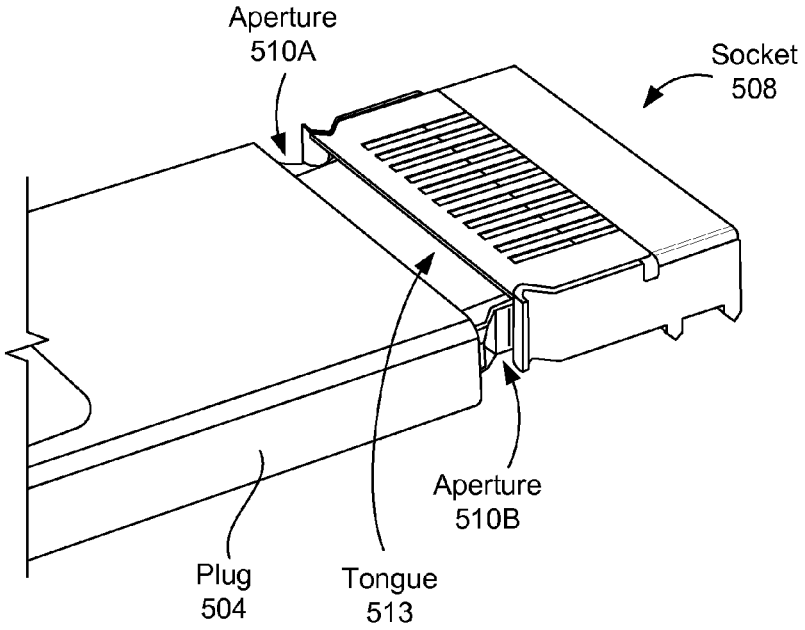
FIG. 5C is a diagram showing a plug of the electrical connector inserted into the socket.

FIG. 5C is a diagram showing the plug 504 inserted into the socket 508. In this example, the tongue portion 513 of the plug 504 includes apertures 510A, 510B. The apertures 510A, 510B may receive latches (labeled in FIG. 5D) of the socket 508, securing the tongue portion 513 of the plug 504 into the socket 508.

Figure 5D:
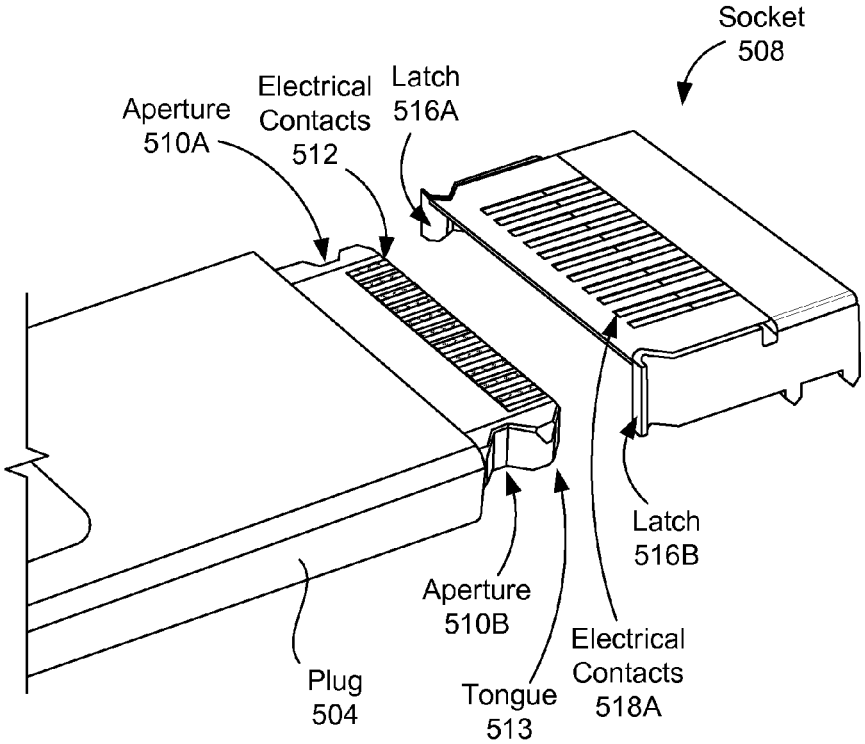
FIG. 5D shows the plug and the socket according to an example embodiment.

FIG. 5D shows the plug 504 and the socket 508 according to an example embodiment. As shown in FIG. 5B, the latches 516A, 516B of the socket 508 may extend inward from arms (not labeled in FIG. 5D) of the socket 508. The latches 516A, 516B may be biased to extend inward within the socket 508. While the plug 504 is being inserted into the socket 508, the latches 516A, 516B may be forced outward to expand the socket 508 and allow the tongue portion 513 of the plug 504 to enter the socket 508. The latches 516A, 516B may extend into the apertures 510A, 510B of the tongue portion 513 when the plug 504 is fully inserted into the socket 508. The extension of the latches 516A, 516B into the apertures 510A, 510B may secure the plug 504 within the socket 508.

Figure 5E:
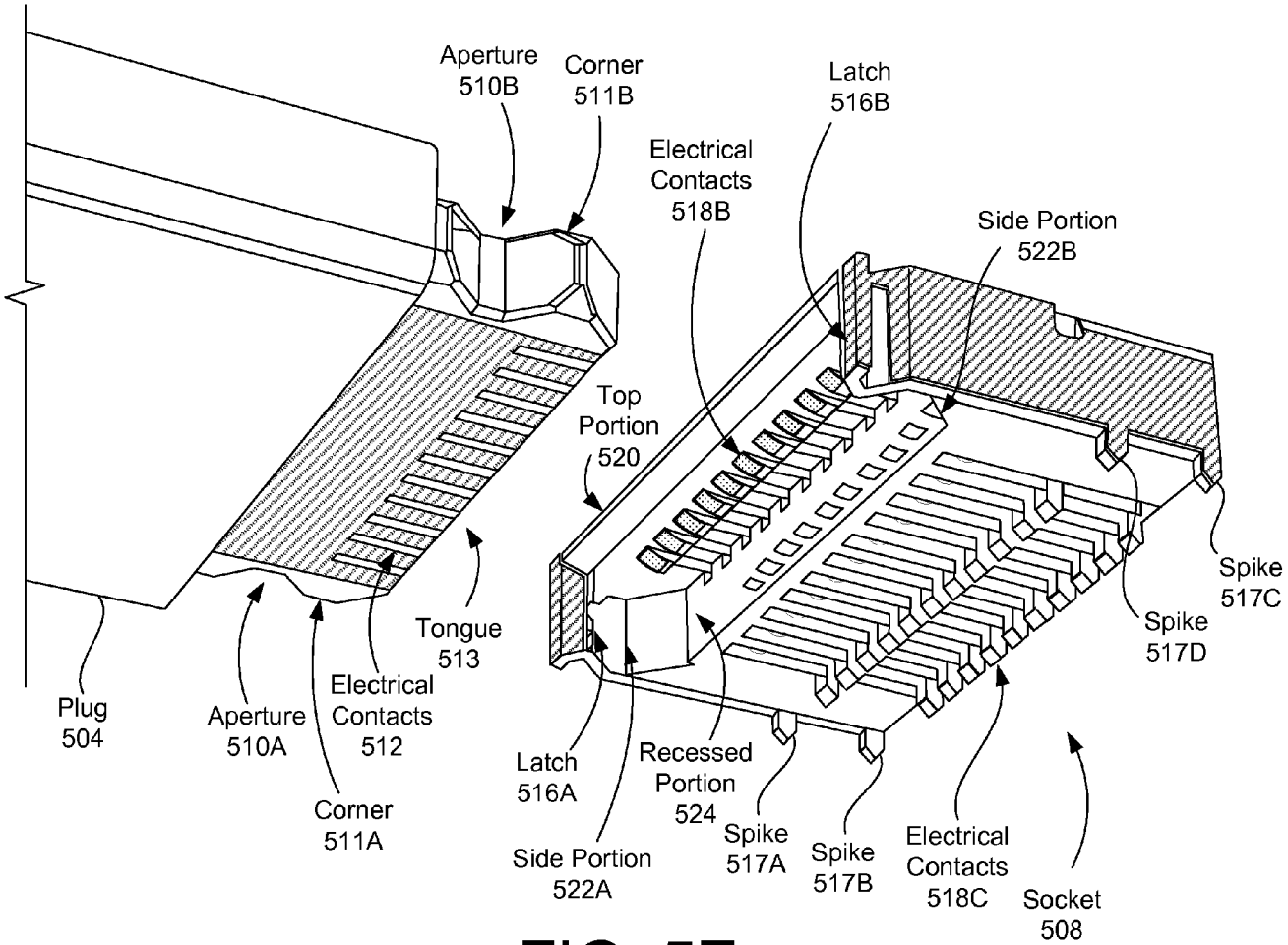
FIG. 5E is a diagram showing the plug and the socket.

FIG. 5E is a diagram showing the plug 504 and the socket 508. As shown in FIG. 5E, the electrical contacts 512 on the tongue portion 513 of the plug 504 may extend away from the plug 504. The plug 504 may include a plurality of electrical contacts 512 that extend in finger-like format away from the plug 504, in a direction opposite from the strain relief 506 (not shown in FIG. 5E) and cord 502 (not shown in FIG. 5E). The electrical contacts 512 may be located on both a top side and the bottom side of the plug 504, allowing the plug 504 to be rotated one-hundred and eighty degrees and still inserted into the socket 508 with the contacts 512 of the plug 504 coupling with contacts 518 of the socket 508. The contacts 512 on the top and bottom sides of the plug 504 may be coupled to each other, causing the plug 504 to have the same functionality when rotated.

The socket 508 may include a top portion 520 and side portions 522A, 522B. The side portions 522A, 522B may extend perpendicularly from opposite ends of the top portion 520. The top portion 520 and side portions 522A, 522B may define a recessed portion 524. The recessed portion 524 may have dimensions similar to, or slightly larger than, the tongue 513 of the plug 504. The recessed portion 524 may receive the tongue 513. In an example embodiment, the latches 516A, 516B may not be attached or connected to the top portion 520, allowing the latches 516A, 516B to bend away from the recessed portion 524 when the tongue 513 is inserted into the recessed portion 524.

The socket 508 may also include electrical contacts 518. The electrical contacts 518 of the socket 508 may make contact with, and couple with, the electrical contacts 512 of the plug 504, when the tongue 513 is inserted into the recessed portion 524. The electrical contacts 518 may be made of an electrically conductive material, such as metal including copper, aluminum, gold, or silver. The electrical contacts 518 may include flattened portions extending away from the top portion 520 of the socket 508, at an angle between ten and thirty degrees, into the recessed portion 524. When the plug 504 is inserted into the socket 508, the plug 504 and/or electrical contacts 512 may press the electrical contacts 518 upward away from the plug 504 and against the top portion 520 of the socket 508. The extension of the electrical contacts 518 away from the socket 508 and into the recessed portion 624 may ensure that the electrical contacts 518 of the socket 508 press against, and contact, the electrical contacts 512 of the plug 504, maintaining the electrical coupling between the electrical contacts 512, 518.

The socket 508 may also include a plurality of spikes 517A, 517B, 517C, 517D. The spikes 517A, 517B, 517C, 517D may extend from a bottom portion of the socket 508. The spikes 517A, 517B, 517C, 517D may facilitate securing the socket 508 within the portable computing device 300A, 300B. The spikes 517A, 517B, 517C, 517D may, for example, be soldered into the portable computing device 300A, 300B. The portable computing device 300A, 300B may, for example, have recesses or apertures into which the spikes 517A, 517B, 517C, 517D are soldered.

Figure 6A:
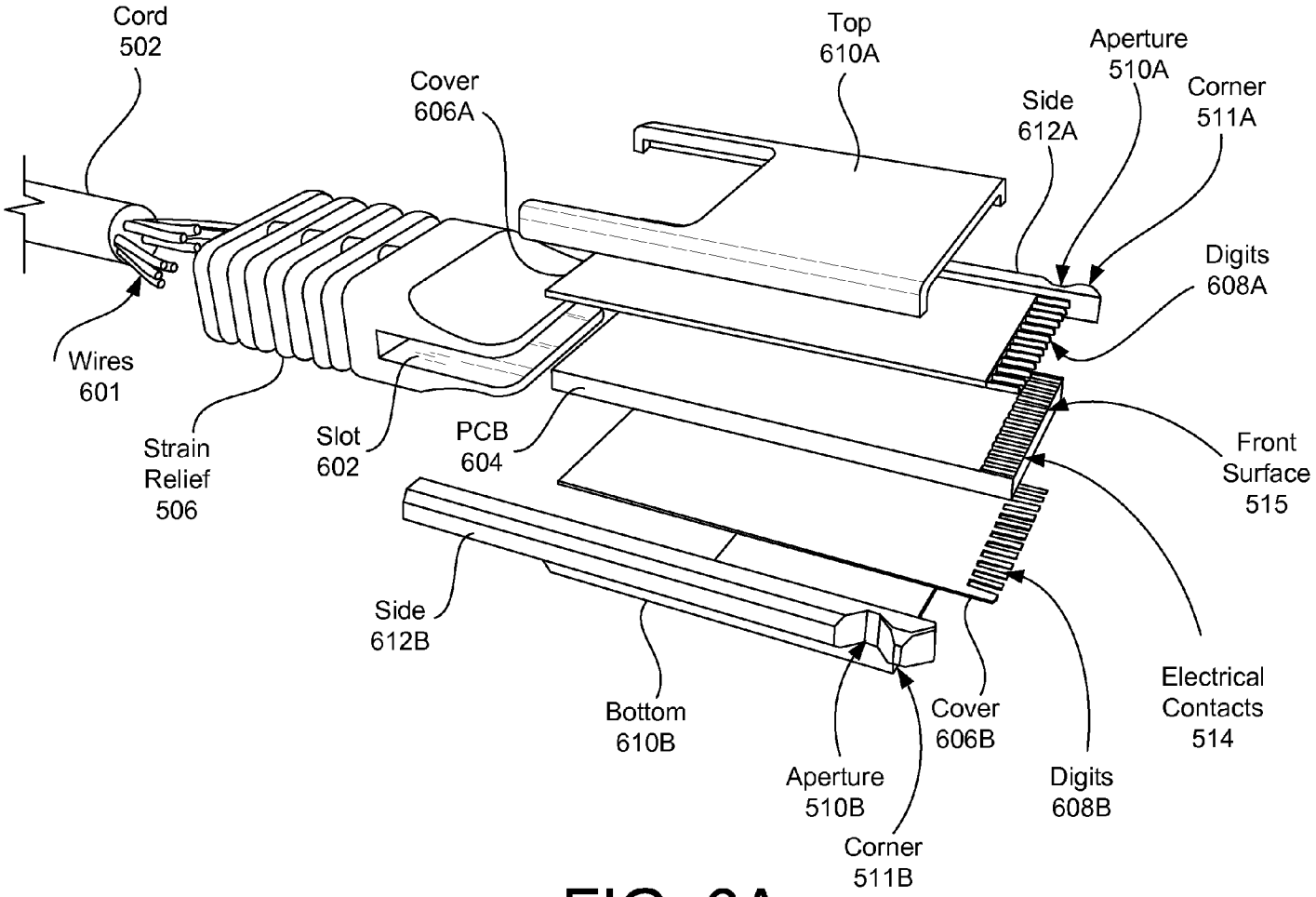
FIG. 6A is a diagram showing components of the electrical connector according to an example embodiment.

FIG. 6A is a diagram showing components of the electrical connector according to an example embodiment. FIG. 6A shows the wires 601 within the cord 502. The wires 601 may include conductive wires, such as metal wires, and may each include wires within an insulator, such as a plastic or rubber tube. The insulator may prevent crosstalk or interference between the signals carried by the wires 601.

The strain relief 506 may include a slot 602. The strain relief 506 may include the slot 602 at an opposite end from the cord 502. The slot 602 may receive a printed circuit board (PCB) 604. The slot 602 may hold the PCB 604 in place within the strain relief 506. The PCB 604 may be inserted into the slot 602, securing the PCB within the slot 602 and the strain relief 506.

The PCB 604 may include contacts and/or wires (not shown) coupling the electrical contacts 514 to the wires 601. The contacts and/or wires coupling the electrical contacts 514 to the wires 601 may, for example, extend through the PCB 604, or along a top or bottom of the PCB 604. The electrical contacts 514 may extend along a top and/or bottom surface of the PCB 604 to or near the front surface 515 of the PCB 604, according to example embodiments.

The plug 504 may also include covers 606A, 606B. The covers 606A, 606B may be laid on the top and bottom of the PCB 604 respectively. The covers 606A, 606B may protect the PCB 604, and may prevent damage to contacts and/or wires coupling the electrical contacts 514 to the wires 601.

The covers 606A, 606B may include digits 608A, 608B. The digits 608A, 608B may extend between the electrical contacts 514 of the PCB 604. Inversely, the electrical contacts 514 may extend between the digits 608A, 608B. The digits 608A, 608B may give an upraised appearance to the slots between the electrical contacts 514.

The plug 504 may also include a top 610A and bottom 610B. The top 610A and bottom 610B may include flat, rigid materials laid on the top and bottom of the covers 608A, 608B, respectively. The top 610A and bottom 610B may hold the PCB 604 and covers 606A, 606B together.

The plug 504 may also include sides 612A, 612B. The sides 610A, 612B may be inserted along sides of the PCB 604, and may be adjacent to the top 610A and bottom 610B. The sides 612A, 612B may be made of a rigid material such as plastic or metal. The sides 612A, 612B may be elongated, having lengths from the end of the PCB 604 near the strain relief 506 to the end of the PCB 604 that includes the electrical contacts 514 several times, such as at least five times, a width and/or depth of the sides 612A, 612B.

Ends of the sides 612A, 612B may include chamfered corners 511A, 511B. The corners 511A, 511B may be located at end portions of the sides 610A, 610B opposite from the strain relief 506. The sides 610A, 610B may also include recesses defining the apertures 510A, 510B behind the corners 511A, 511B.

Figure 6B:
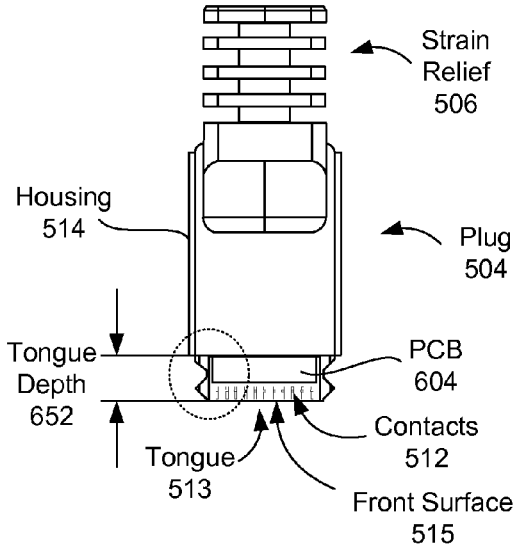
FIG. 6B is a diagram showing dimensions of the plug according to an example embodiment.

FIG. 6B is a diagram showing dimensions of the plug 504 according to an example embodiment. In this example, a tongue depth 652, which may be an extension of the PCB 604 and contacts 512 beyond the housing 514, may be between three and four millimeters. The dashed circle shows a portion of the plug 604 that is shown in greater detail in FIG. 6E.

Figure 6C:
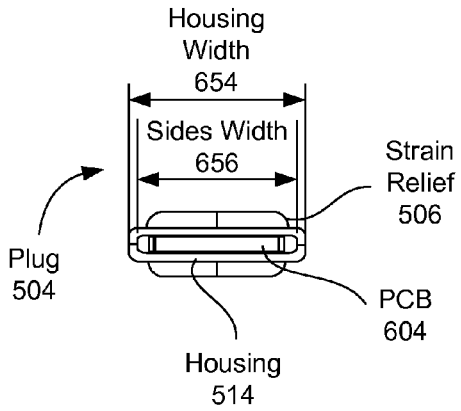
FIG. 6C is a diagram showing dimensions of the plug according to an example embodiment.

FIG. 6C is a diagram showing dimensions of the plug 504 according to an example embodiment. In this example, a housing width 504 may be a distance between outside edges of the housing 604, and may be between ten and eleven millimeters. The housing width 654 may also be a distance between outer portions of the sides 612A, 612B. Also in this example, a sides width 656 may be a distance between inner portions of the housing 604 or between inner portions of the sides 612A, 612B, and may be between nine and ten millimeters. In an example implementation, the housing width 654 may be greater than the sides width 656, and both the housing width 654 and sides width 656 may be greater than, such as at least two times or at least three times, the tongue depth 652 (shown in FIG. 6B).

Figure 6D:
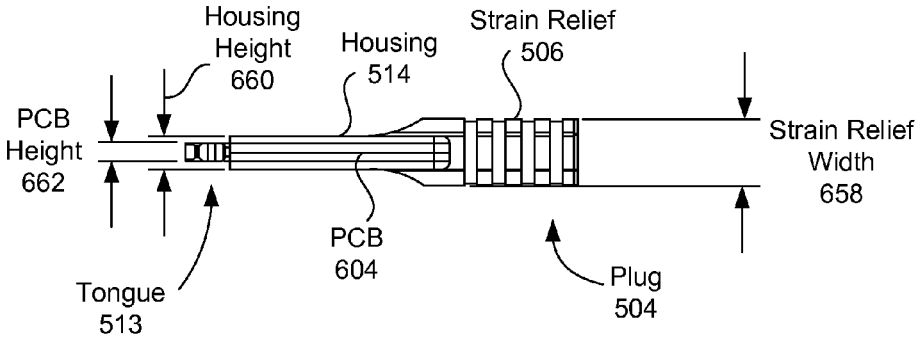
FIG. 6D is a diagram showing dimensions of the plug according to an example embodiment.

FIG. 6D is a diagram showing dimensions of the plug 504 according to an example embodiment. In this example, a housing height 660 may be a distance between outer portions and/or planes of the top and bottom of the housing 514 and/or between outer portions of the top 610A and bottom 610B, and may be between two and three millimeters. A PCB height 662 may be a distance between top and bottom portions of the PCB 604, on which the covers 606A, 606B lay, and may be between 1.0 and 1.5 millimeters. In an example implementation, the housing height 660 may be greater than the PCB height 612, and the tongue depth 652 may be greater than both the housing height 660 and the PCB height 662.

Figure 6E:
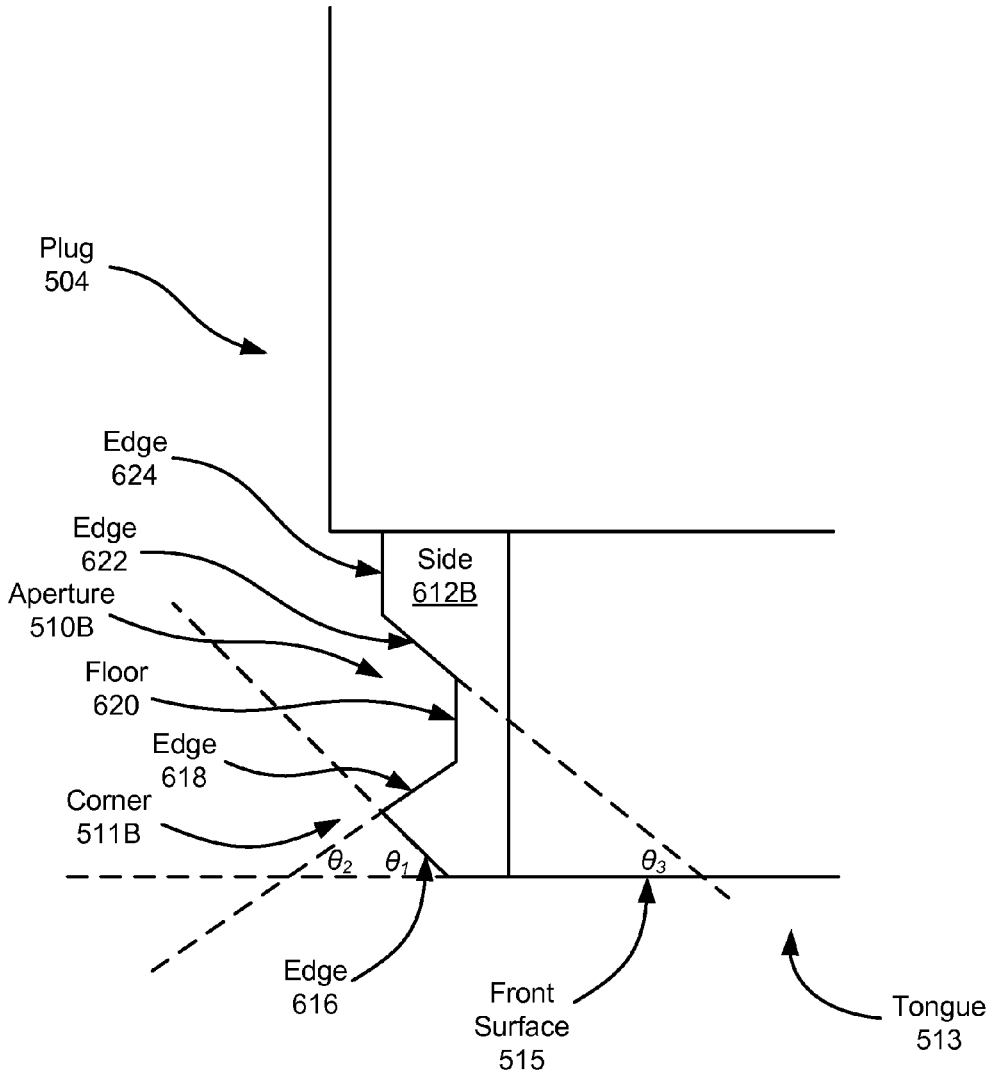
FIG. 6E is a diagram showing the corner and aperture of the tongue according to an example embodiment.

FIG. 6E is a diagram showing the corner 511B and aperture 510B of the tongue 513 according to an example embodiment. The aperture 510B may be adjacent to the corner 511B. The opposite corner 511A and aperture 510A (not shown in FIG. 6E) may have similar features and/or dimensions to the corner 511B and aperture 510B.

As discussed above, the corner 511B of the tongue 513 may be chamfered, allowing tongue 513 to slide past the latches 516A, 516B (not shown in FIG. 6E) into the recessed portion 524 (not shown in FIG. 6E). The chamfering of the corner 511B may be defined by a first edge 616. The first edge 616 included in the tongue 513 may extend away from a plane extending along the front surface 515 of the tongue 513 at an angle $\Theta_1$. The angle $\Theta_1$ may be, for example, between forty and fifty degrees, or between thirty and sixty degrees.

In an example embodiment, the aperture 510B may form a trough with tapered ends. To define the trough, the tongue 513 may include a second edge 618 which partially defines the aperture 510B. The second edge 618 may be adjacent to the first edge 618. A plane extending from the second edge may form an angle $\Theta_2$ with the plane extending along the front surface 515 of the tongue 513. The angle $\Theta_2$ may have a similar angle to the angle $\Theta_1$, such as between forty and fifty degrees or between thirty and sixty degrees.

The tongue 513 may include a floor 620 adjacent to the second edge 618. The floor 620 may form an angle with the second edge 618 of, for example, between one-hundred and thirty degrees and one-hundred and forty degrees, or between one-hundred and twenty degrees and one-hundred and fifty degrees. The floor 620 may extend parallel to the direction that the tongue 513 extends from the plug 504, and/or perpendicular to the plane extending along the front surface 515. The floor 620, which partially defines the aperture 510B, may provide room for the latch 516B to slide and/or fit into the aperture 510B.

The tongue 513 may include a third edge 622 which, with the floor 520 and second edge 618, defines the aperture 510B. The third edge 622 may be adjacent to the floor 620. The third edge 622 may form an angle with the floor 620 of, for example, between one-hundred and thirty degrees and one-hundred and forty degrees, or between one-hundred and twenty degrees and one-hundred and fifty degrees. A plane extending from the third edge 622 may form an angle $\Theta_3$ with the plane extending along the front surface 515 of the tongue 513. The angle $\Theta_3$ may have a similar angle to the angles $\Theta_1$ and $\Theta_2$, such as between forty and fifty degrees or between thirty and sixty degrees.

The tongue 513 may include a fourth edge 624. The fourth edge 624 may be adjacent to the third edge 622. The fourth edge 624 may extend parallel to the direction that the tongue 513 extends from the plug 504, and/or perpendicular to the plane extending along the front surface 515.

While the corner 511B and aperture 510B have been described above in terms of edges 616, 618, 622, 624 and a floor 620 which extend away from each other at particular angles and form a trough with tapered ends, the corner 511B and/or aperture 510B may also be circular or oval-shaped. In an example in which either the corner 511B and/or aperture 510B is circular or oval-shaped, a radius of curvature or distance from a center to the perimeter of either or both the corner 511B and/or aperture 510B may be, for example, between one-tenth and one-fifth, or between one-twentieth and one-fifth of the sides width 656 and/or housing width 654, according to an example embodiment.

Figure 7A:
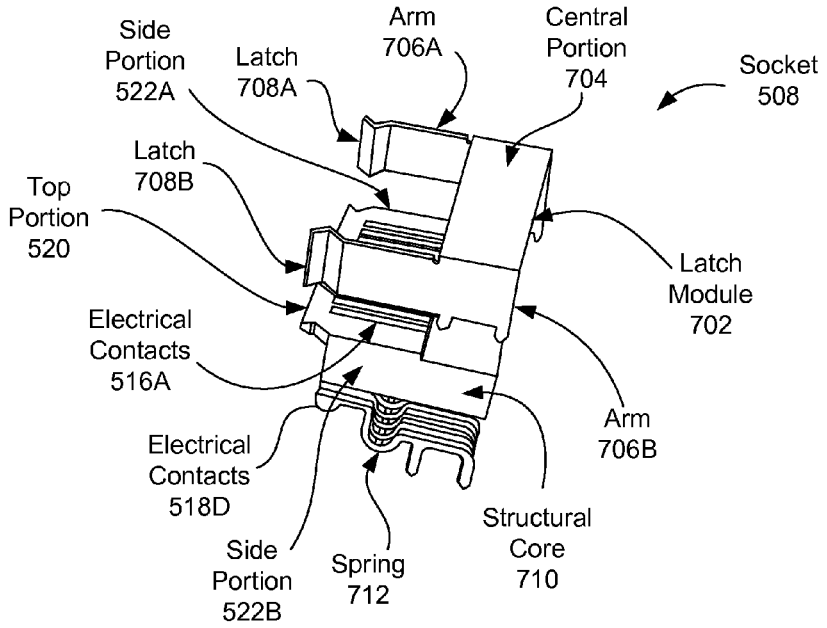
FIG. 7A is a diagram showing components of the socket according to an example embodiment.

FIG. 7A is a diagram showing components of the socket 508 according to an example embodiment. The socket 508 may include a latch module 702. The latch module 702 may secure the plug 504 (not shown in FIG. 7A) within the socket 508. The latch module 702 may include a central portion 704. The latch module 702 may also include arms 706A, 706B extending from the central portion 704. The arms 706A, 706B may include the latches 516A, 516B. The latches 516A, 516B may extend inwardly from the arms 706A, 706B.

The socket 508 may also include a structural core 710. The structural core 710 may include the electrical contacts 516 which couple to the electrical contacts 514 of the plug 504. The structural core 710 may include a body and define a receptacle portion that receives the plug 504. The electrical contacts 516 may extend from a top portion of the structural core 710 into the receptacle portion. The latch module 702 may lay on top of the structural core 710 so that the latches 516A, 516B extend into a cavity or recessed portion defined by the structural core 710. The socket 508 may also include electrical contacts 518D on a bottom of the structural core 710. The electrical contacts 518D may couple to the electrical contacts 516A and transmit the signal received from the electrical connector 100, 200 (not shown in FIG. 7A) to the portable computing device 300A, 300B. The socket 508 may also include a spring 712. The spring 712 may secure the socket 508 within the computing device.

Figure 7B:
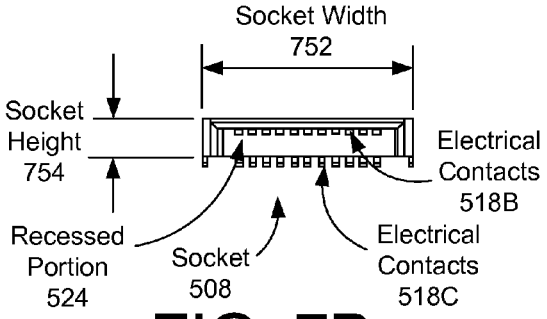
FIG. 7B is a diagram showing dimensions of the socket according to an example embodiment.

FIG. 7B is a diagram showing dimensions of the socket 508 according to an example embodiment. In this example, a socket width 752, or width of the socket 508, may be greater than, such as at least twice, at least three times, at least four times, at least five times, or at least six times a socket height 754, or height of the socket 508, according to example embodiments, and/or between nine and eleven millimeters. The socket height 754, or height of the socket 508, may be between 1.5 and 2.0 millimeters. FIG. 7B also shows the electrical contacts 518B, 518C extending down from the socket 508. The electrical contacts 518B may extend at an angle of, for example, between five and forty-five degrees, between five and thirty, or between ten and thirty degrees.

Figure 7C:
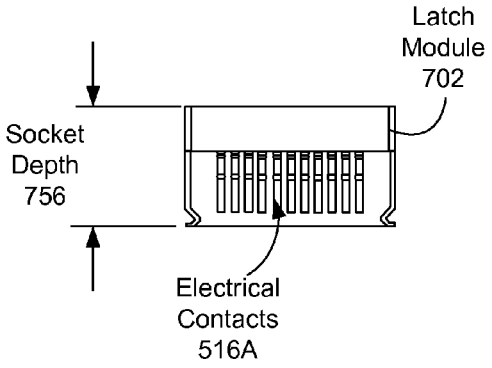
FIG. 7C is a diagram showing dimensions of the socket according to an example embodiment.

FIG. 7C is a diagram showing dimensions of the socket 508 according to an example embodiment. In this example, a socket depth 756, or depth of the socket 508, which may be measured from an opening of the socket 508 to a backstop (similar to the backstop 412 shown in FIG. 4G with respect to the socket 302A, 302B), may be between five and six 5.79 millimeters, and/or greater than the socket height 704 and less than the socket width 702. The socket depth 756 may, for example, be at least twice the socket height 704. The electrical contacts 516A on top of the latch module 702 may be coupled to the electrical contacts 516B and the electrical contacts 516C.

Figure 7D:
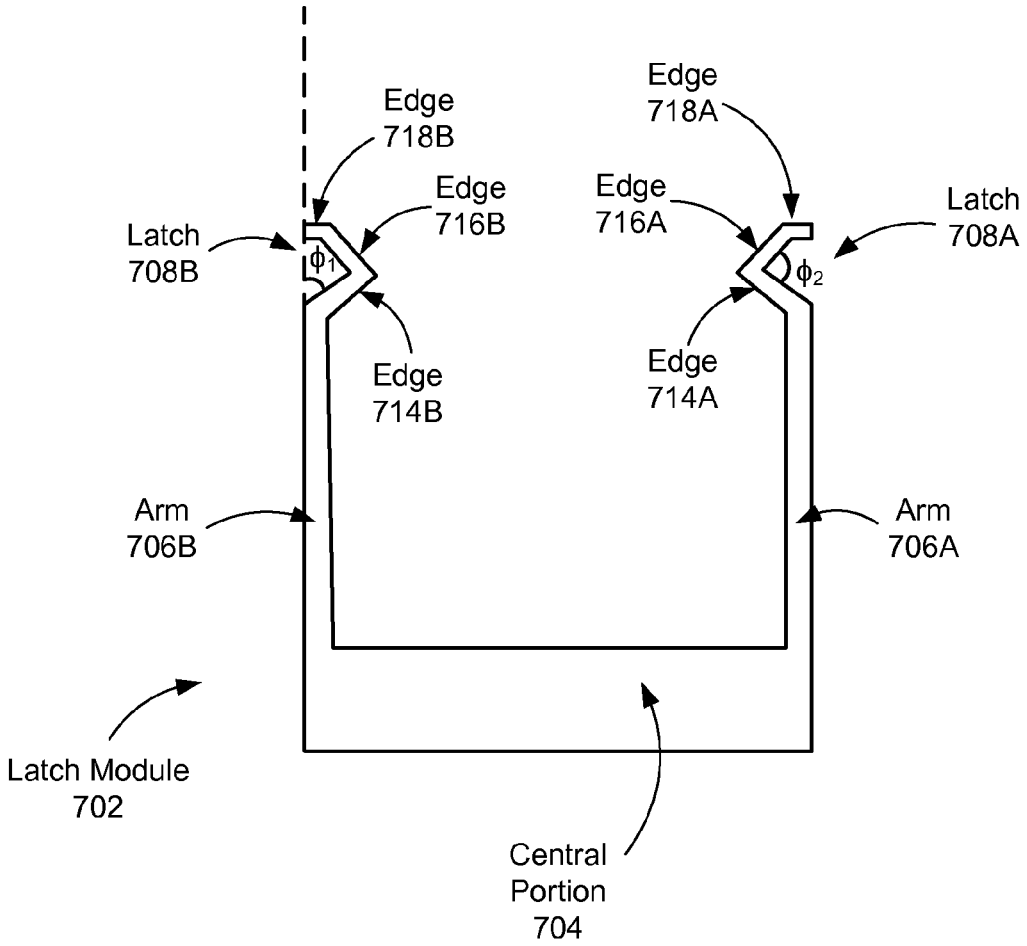
FIG. 7D is a diagram showing a latch module of the socket according to an example embodiment.

FIG. 7D is a diagram showing the latch module 702 of the socket 508 according to an example embodiment. The latch module 702 may include the central portion 704 and the arms 706A, 706B extending perpendicularly from the central portion.

The latches 708A, 708B may be located at ends of the respective arms 706A, 706B. The location of the latches 708A, 708B at the ends of the respective arms 706A, 706B may minimize the length of the arms 706A, 706B and allow the length of the tongue 513 (not shown in FIG. 7D) to be minimized, facilitating the release of the tongue 513 from the socket 508 (not shown in FIG. 7D). The latches 708A, 708B may be V-shaped. The bottoms of the respective V's may point toward the opposite latch 708A, 708B; the bottom of the V of the latch 708A may point toward the latch 708B, and the bottom of the V of the latch 708B may point toward the latch 708A.

In an example embodiment, the V-shaped latches 708A, 708B may each be formed by a first edge 714A, 714B and a second edge 716A, 716B. The first edge 714A, 714B may extend toward the opposite latch 708A, 708B, forming an angle $\phi_1$ away from a line or plane tangent to the arm 706A, 706B from which the first edge 714A, 714B extends. The angle $\phi_1$ may be, for example, between forty and fifty degrees, or between thirty and sixty degrees. The second edge 716A, 716B may extend back toward the line or plane tangent to the arm 706A, 706B from which the first edge 714A, 714B extends. The second edge 716A, 716B may form an angle $\phi_2$ from the first edge 714A, 714B. The angle $\phi_2$ may be, for example, between eighty and one-hundred degrees, or between sixty and one-hundred and twenty degrees. The lengths of the first and second edges 714A, 714B, 716A, 716B may be, for example, between one-twentieth and one-fifth of the socket width 752 (not shown in FIG. 7D), or between one-tenth and one-fifth of the socket width 752.

The latches 708A, 708B may also include a third edge 718A, 718B. The third edge 718A, 718B may extend from the second edge 716A, 716B in a direction away from the opposite latch 708A, 708B. The third edge 718A, 718B may extend away from the opposite latch 708A, 708B in a direction perpendicular to the line or plane tangent to the arm 706A, 706B from which the first edge 714A, 714B extends. The third edge 718A, 718B may terminate at the plane tangent to the arm 706A, 706B from which the first edge 714A, 714B extends. In an example embodiment, after the termination of the second edge 716A, 716B and third edge 718A, 718B, no component of the latch module 702 may extend in a direction away from the central portion 704. The absence of any component of the latch module 702 extending in the direction away from the central portion 704 may minimize the length of each arm 706A, 706B, allowing the length of the tongue 513 to be minimized.

While the latches 708A, 708B have been described above as V-shaped, the latches 708A, 708B may also be semicircular or oval-shaped. In the example of semicircular or oval-shaped latches 708A, 708B, the radius of curvature of distance from a center to a perimeter or edge of the latches 708A, 708B may be, for example, between one-twentieth and one-fifth of the socket width 752, or between one-tenth and one-fifth of the socket width 752.

While certain features of the described implementations have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. An electrical connector comprising:

an electrical cord comprising a plurality of electrical wires; and a plug connected to the electrical cord, the plug defining at least one aperture, the at least one aperture having an open end at an end surface of the plug opposite from the electrical cord, the plug comprising:

electrical contacts coupled to the plurality of electrical wires; and at least one latch, the at least one latch extending through the at least one aperture and biased to extend away from the plug.

2. The electrical connector of claim 1, wherein the end surface of the at least one latch is flush with the end surface of the plug opposite from the electrical cord.

3. The electrical connector of claim 1, wherein the plug comprises:

a non-conductive inner core comprising a plurality of tunnels; and a collar surrounding the non-conductive inner core, the collar comprising the at least one latch.

4. The electrical connector of claim 3, wherein the collar comprises:

a first portion that is generally flat;

a second portion adjacent to the first portion, the second portion being generally round;

a third portion adjacent to the second portion, the third portion being generally flat and generally parallel to the first portion; and a fourth portion adjacent to the third portion and the first portion, the fourth portion being generally round.

5. The electrical connector of claim 4, wherein the first portion of the collar has a width that is at least twice a depth of the first portion of the collar, the depth along a direction that is generally parallel to a direction in which the electrical contacts extend through the plug.

6. The electrical connector of claim 4, wherein the first portion of the collar has a width that is at least three times a depth of the first portion of the collar, the depth along a direction that is generally parallel to a direction in which the electrical contacts extend through the plurality of tunnels.

7. The electrical connector of claim 4, wherein the first portion of the collar has a width that is at least five times a distance between the first portion of the collar and the third portion of the collar, the width along a direction that is generally perpendicular to a direction in which the electrical contacts extend through the plurality of tunnels.

8. The electrical connector of claim 4, wherein the first portion of the collar has a depth that is greater than a distance between the first portion of the collar and the third portion of the collar, the depth along a direction that is generally parallel to a direction in which the electrical contacts extend through the plurality of tunnels.

9. The electrical connector of claim 4, wherein the at least one latch comprises:

a first latch extending from the second portion; and a second latch extending from the fourth portion.

10. The electrical connector of claim 3, wherein the collar comprises:

a first portion that is generally flat;

a second portion adjacent to the first portion, the second portion being generally semicircular;

a third portion adjacent to the second portion, the third portion being generally flat and generally parallel to the first portion; and a fourth portion adjacent to the third portion and the first portion, the fourth portion being generally semicircular.

11. The electrical connector of claim 3, wherein the collar comprises a rigid, conductive material.

12. The electrical connector of claim 3, wherein the at least one latch extends from a half portion of the collar that is distal to the electrical cord.

13. The electrical connector of claim 3, wherein the at least one latch extends from a quarter portion of the collar that is distal to the electrical cord.

14. The electrical connector of claim 1, wherein a portion of the plug comprises ribs for enhancing flexibility.

15. The electrical connector of claim 1, wherein the at least one latch comprises at least one spring leaf.

16. The electrical connector of claim 1, wherein the electrical contacts comprise a Universal Serial Bus (USB) interface.

17. An electrical connector comprising:

an electrical cord comprising a plurality of electrical wires; and a plug connected to the electrical cord, the plug comprising:

a first portion, a second portion adjacent to the first portion, a third portion opposing the first portion and adjacent to the second portion, and a fourth portion opposing the second portion and adjacent to the first portion and the third portion, the first portion, second portion, third portion, and fourth portion surrounding a mouth configured to receive a tongue of an electrical receptacle;

electrical contacts coupled to the plurality of electrical wires and configured to engage contacts of the electrical receptacle when the mouth receives the tongue of the electrical receptacle;

a first latch extending through the second portion, the first latch being configured to engage the electrical receptacle; and a second latch extending through the fourth portion, the second latch being configured to engage the electrical receptacle.

18. The electrical receptacle of claim 17, further comprising:

a structural core surrounded by the first portion, second portion, third portion, and fourth portion, the structural core defining the mouth; and an overmold around a portion of the structural core and portions of the first portion, the second portion, the third portion, and the fourth portion, the overmold being made of non-conductive material.

19. The electrical receptacle of claim 17, wherein the electrical contacts are configured to engage contacts on the tongue of the electrical receptacle.

20. The electrical receptacle of claim 17, wherein the first latch is spring-loaded and the second latch is spring-loaded.

21. The electrical receptacle of claim 17, wherein the electrical contacts comprise a Universal Serial Bus (USB) interface.

22. A Universal Serial Bus (USB) device comprising:

a structural core including a top portion and opposing side portions defining a recessed portion;

a plurality of electrical contacts extending from the structural core into the recessed portion; and a latch module comprising at least one arm extending along one of the side portions of the structural core, the at least one arm including a latch extending into the recessed portion.

23. The USB device of claim 22, wherein the latch is V-shaped.

24. The USB device of claim 22, wherein the latch is semicircular.

25. The USB device of claim 22, wherein the latch is oval-shaped.

26. The USB device of claim 22, wherein:

the at least one arm comprises a first arm including a first latch extending into the recessed portion;

the USB device comprises a second arm extending along an opposite side portion from the first arm, the second arm comprising a second latch extending into the recessed portion; and the USB device comprises a central portion extending from the first arm to the second arm.

27. The USB device of claim 22, wherein the latch module is made of one piece and comprises:

the at least one arm, the at least one arm comprising a first arm including a first latch extending into the recess portion;

a second arm extending along an opposite side portion from the first arm, the second arm comprising a second latch extending into the recessed portion; and a central portion extending from the first arm to the second arm.

28. The USB device of claim 22, wherein the latch is V-shaped and is formed by:

a first edge, the first edge extending toward the recessed portion at a first angle away from a plane tangent to the at least one arm, the first angle being between thirty and sixty degrees; and a second edge extending back toward the plane tangent to the at least one arm at a second angle from the first edge, the second angle being between sixty and one-hundred and twenty degrees.

29. The USB device of claim 22, wherein the at least one latch is biased into the recessed portion.

30. The USB device of claim 22, wherein one of, the at least one arm and the side portion along which the at least one arm extends, is between the other of, the at least one arm and the side portion along which the at least one arm, and the recessed portion.

31. An electrical connector comprising:

an electrical cord comprising a plurality of electrical wires; and a plug connected to the electrical cord, the plug defining a mouth configured to receive a tongue of an electrical receptacle, the plug comprising:

electrical contacts coupled to the plurality of electrical wires and configured to engage contacts of the electrical receptacle when the mouth receives the tongue of the electrical receptacle, the electrical contacts being located on both a top side and a bottom side of the plug and coupled to each other so that the plug has the same functionality when rotated one-hundred and eighty degrees; and at least one latch, the at least one latch being configured to engage the electrical receptacle.

* * * * *